US009905331B2

(12) United States Patent
Jo et al.

(10) Patent No.: US 9,905,331 B2
(45) Date of Patent: Feb. 27, 2018

(54) COMPOSITE ELECTRIC WIRE STRUCTURE AND METHOD FOR MANUFACTURING THE SAME

(71) Applicant: KOREA INSTITUTE OF SCIENCE AND TECHNOLOGY, Seoul (KR)

(72) Inventors: Han Ik Jo, Wanju-gun (KR); Su Young Son, Wanju-gun (KR); Sung Ho Lee, Wanju-gun (KR); Dong Su Lee, Wanju-gun (KR); Tae-Wook Kim, Wanju-gun (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 15/177,816

(22) Filed: Jun. 9, 2016

(65) Prior Publication Data

US 2016/0365165 A1 Dec. 15, 2016

(30) Foreign Application Priority Data

Jun. 9, 2015 (KR) ..... 10-2015-0081520

(51) Int. Cl.

| | |
|---|---|
| ***H01B 11/18*** | (2006.01) |
| ***H01B 5/00*** | (2006.01) |
| ***H01B 1/02*** | (2006.01) |
| ***H01B 5/02*** | (2006.01) |
| ***H01B 5/12*** | (2006.01) |
| ***H01B 7/18*** | (2006.01) |

(52) U.S. Cl.

CPC ..... *H01B 5/002* (2013.01); *H01B 1/02* (2013.01); *H01B 1/026* (2013.01); *H01B 5/02* (2013.01); *H01B 5/12* (2013.01); *H01B 7/1805* (2013.01)

(58) Field of Classification Search

CPC ..... H01B 11/18
USPC ..... 174/126.1, 126.2
See application file for complete search history.

(56) References Cited

U.S. PATENT DOCUMENTS

| | | | | |
|---|---|---|---|---|
| 5,532,434 | A * | 7/1996 | Takeno | B23K 26/18 174/110 A |
| 8,445,788 | B1 * | 5/2013 | Tsotsis | H01B 1/24 174/126.1 |
| 9,299,473 | B2 * | 3/2016 | Schmidt | H01B 1/04 |
| 9,409,781 | B2 | 8/2016 | Joh et al. | |

(Continued)

FOREIGN PATENT DOCUMENTS

| | | |
|---|---|---|
| KR | 10-2011-0093666 A | 8/2011 |
| KR | 10-1063359 B1 | 9/2011 |

(Continued)

OTHER PUBLICATIONS

Extended European Search Report issued in counterpart European Application No. 16173721.8 dated Nov. 8, 2016 (6 pages).

(Continued)

*Primary Examiner* — Chau N Nguyen
(74) *Attorney, Agent, or Firm* — NSIP Law

(57) ABSTRACT

Provided are a composite electric wire structure wherein a carbon material island structure is formed on a surface of a metal wire and a method for manufacturing the same. The carbon material/metal composite electric wire is capable of solving stability problem and preventing a decrease in electrical properties, mechanical properties, etc. In addition, the composite electric wire structure may be produced in commercially viable large scale.

17 Claims, 22 Drawing Sheets

(56) References Cited

U.S. PATENT DOCUMENTS

| | | | | |
|---|---|---|---|---|
| 2005/0042161 | A1* | 2/2005 | Carlisle | C23C 16/274 423/446 |
| 2006/0086958 | A1* | 4/2006 | Eimori | B82Y 10/00 257/301 |
| 2006/0151803 | A1* | 7/2006 | Wesner | C02F 1/46109 257/103 |
| 2012/0128573 | A1* | 5/2012 | Yoo | B82Y 30/00 423/447.1 |
| 2012/0237692 | A1 | 9/2012 | Nam et al. | |
| 2012/0282446 | A1 | 11/2012 | Jo et al. | |
| 2012/0298396 | A1 | 11/2012 | Hong et al. | |
| 2013/0048919 | A1* | 2/2013 | Chung | C01B 31/0226 252/502 |
| 2013/0140058 | A1* | 6/2013 | Kim | C01B 31/0469 174/126.2 |
| 2014/0299475 | A1 | 10/2014 | Bullington et al. | |

FOREIGN PATENT DOCUMENTS

| | | | |
|---|---|---|---|
| KR | 10-2012-0104827 | A | 9/2012 |
| KR | 10-2012-0137844 | A | 12/2012 |
| KR | 10-2013-0051418 | A | 5/2013 |
| KR | 10-2013-0058389 | A | 6/2013 |
| KR | 10-2014-0105442 | A | 1/2014 |
| KR | 10-2014-0030982 | A | 3/2014 |
| KR | 10-1425376 | B1 | 8/2014 |
| KR | 10-1503283 | B1 | 3/2015 |
| WO | WO 2015/041439 | A1 | 3/2015 |

OTHER PUBLICATIONS

Eres, G., et al., "Cooperative island growth of large-area single-crysal graphene on copper using chemical vapor deposition," ACS Nano vol. 8, No. 6, 2014 (pp. 5657-5669).

Lee, J., et al., "Wafer-scale growth of single-crystal monolayer graphene on reusable hydrogen-terminated germanium," Sciencexpress, Apr. 3, 2014 (6 pages).

Seah, C. et al., "Mechanisms of graphene growth by chemical vapour deposition on transition metals," Carbon, vol. 70, 2014 (pp. 1-21).

Yoo, K. et al., "Electrical transport properties of graphene-covered-Cu wires grown by chemical vapor deposition," Current Applied Physics, vol. 12.1, 2012 (pp. 115-118).

* cited by examiner

Prior art

Prior art

COMPOSITE ELECTRIC WIRE STRUCTURE AND METHOD FOR MANUFACTURING THE SAME

CROSS-REFERENCE TO RELATED APPLICATION

This application claims the priority of Korean Patent Application No. 10-2015-0081520, filed on Jun. 9, 2015, and all the benefits accruing therefrom under 35 U.S.C. § 119, the contents of which in its entirety are herein incorporated by reference.

BACKGROUND

1. Field

The present disclosure relates to a composite electric wire structure and a method for manufacturing the same.

2. Description of the Related Art

Graphene is a material having a planar (two-dimensional) structure wherein carbon atoms form a hexagonal lattice and exhibits different physical properties from graphite having a three-dimensional structure, carbon nanotubes having a one-dimensional structure, fullerene having a zero-dimensional structure, etc. As reported up to now, a single-layered graphene film exhibits unique characteristics distinguished from other carbon materials, with an electron mobility of about 150,000 $cm^2V^{-1}S^{-1}$, an optical transparency of about 97.5% and a surface area of about 2600 $m^2g^{-1}$. In particular, because electrons behave in graphene as if they were massless due to the peculiar electronic structure of the graphene, electron transport in graphene is very fast. Particularly, it is reported that graphene exhibits electrical conductivity which is 100 times or higher than that of copper.

Meanwhile, at present, electric wires are made of metals, particularly copper (Cu) which is richer and relatively inexpensive as compared to other metals. However, a thin copper electric wire has the problem of power loss because dissipation of heat is difficult. And, a thick copper electric wire has the problem that electrical conductivity is decreased due to the skin effect by which electrons are distributed near the surface of the copper wire. In addition, metals are disadvantageous in that they are easily oxidized in the air and lose their inherent properties. Therefore, researches have been conducted to replace metal wires with flexible carbon materials having superior electrical, thermal and structural properties such as carbon nanotubes or graphene. However, although carbon nanotubes have high length-to-diameter ratios, the length is short to be used as electric wires. And, although carbon fibers have long length and mechanical properties suitable to be used as electric wires, they have low electrical conductivity.

Some researchers have conducted researches to replace metal electric wires with graphene only (Korean Patent Application Publication No. 2011-93666). According to this method, a metal layer is patterned to form a linear catalyst layer. After forming graphene in the catalyst layer via chemical vapor deposition, an electric wire formed of graphene fiber is obtained by removing the catalyst layer. There is another method of depositing a metal on a polymer fiber and forming graphene on the resulting metal layer via chemical vapor deposition (US Patent Application Publication Application No. 2013-0140058).

However, the inventors of the present disclosure have found out that the graphene electric wire is not uniform in the shape of the graphene and has a structural problem of short length similarly to the problem of the carbon nanotubes. In addition, the methods are inapplicable to a continuous process because they employ chemical vapor deposition and the fiber structure may be broken or short fibers may be formed during the step of removing the metal layer.

Also, there are methods where a polymer layer containing a carbon source is coated on the surface of a metal wire and then a graphene layer is formed by irradiating microwaves or intense pulsed light (IPL) (Korean Patent Application Publication No. 2013-58389, Korean Patent Application Publication No. 2013-51418) or where a graphene layer is formed on the surface of a metal wire via chemical vapor deposition (*Current Applied Physics*, K. J. Yoo et al., 2012, 12, 115-118).

According to the existing methods of forming a graphene layer on the surface of a metal wire described above, thick graphene layers are coated continuously on the surface of a metal wire as the whole surface of the metal wire is coated with the graphene layer.

FIGS. 1A and 1B schematically show the structure of graphene formed on a metal wire according to prior art. FIG. 1A schematically shows graphene coated on a metal wire according to the prior art, Korean Patent Application Publication No. 2013-58389 (FIG. 2 of Korean Patent Application Publication No. 2013-58389) and FIG. 1B shows the actual image of graphene coated on a metal wire according to the prior art, Korean Patent Application Publication No. 2013-51418 (FIG. 5 of Korean Patent Application Publication No. 2013-51418).

As can be seen from FIGS. 1A and 1B, graphene is formed on the whole surface of a metal wire in the Korean Patent Application Publication No. 2013-58389 (see FIG. 1A) and graphene is thickly coated on a metal wire in the Korean Patent Application Publication No. 2013-51418 (see FIG. 1B). The prior arts report that the coating of a graphene layer on the metal wire as such leads to improved electrical conductivity, etc.

However, the inventors of the present disclosure have found out that the existing method of forming a graphene layer on the metal wire surface as such has the following problems.

That is, a sheath such as an insulating sheath or a conductor shield is formed on the metal conductor wire for electrical insulation, and thus the sheath contacts with the conductor wire. When the graphene covers the whole surface of the metal wire as in the existing method, the graphene inevitably contacts the sheath such as the insulating sheath etc. However, because the graphene is a carbon material and exhibits poor adhesion to the sheath such as the insulating sheath or the shield layer which are made of an insulating polymer, the structure where the graphene is continuously coated on the metal wire results in a decrease of the adhesion of the sheath to the wire. As a result, during use of the electric wire, the sheath such as the insulating sheath etc. may burst, or short circuit may occur, or shielding property decreases due to the decreased adhesion or decreased insulation. These problems occur very frequently when the electric wire is bent, wound, etc. In particular, for high-capacity electric wires such as the power transmission cables used in transmission towers, short circuit may be very dangerous. Accordingly, the existing method of coating graphene on a metal wire involves a significant safety problem and may be limited in actual application. The existing method does not consider these problems.

In addition, when the graphene layer is coated on the metal wire surface, the graphene layer may be broken under the use environment of the electric wire, especially when the electric wire is bent or wound, graphene may be released from the metal wire as the graphene layer is broken, resulting in decreased electrical conductivity or mechanical properties such as flexibility, elasticity, etc.

Meanwhile, because the electric wire is manufactured by a continuous process, the manufacturing speed greatly affects the cost of the electric wire. Accordingly, a method for manufacturing a composite electric wire structure in commercially viable large scale wherein the composite electric wire structure may exhibit high safety without sheath bursting or short circuit under the use environment of the electric wire, especially when the electric wire is bent or wound, and as well without decrease in electrical conductivity or mechanical properties is also necessary.

SUMMARY

The present disclosure is directed to providing a composite electric wire structure formed of a metal and a carbon material (particularly graphene), which are heterogeneous materials, wherein a carbon material layer is not simply formed on a metal wire but the structure of the carbon material formed on the metal wire is controlled, and a method for manufacturing the same.

The present disclosure is also directed to providing a composite electric wire structure containing a metal and a carbon material, which is capable of preventing decreased adhesion to a sheath such as an insulating sheath, a shield, etc. formed on the composite electric wire structure and, thus, is capable of preventing the bursting of the sheath, short circuit or decreased shielding property when the electric wire is used, especially when the electric wire is bent or wound, and a method for manufacturing the same.

The present disclosure is also directed to providing a composite electric wire structure containing a metal and a carbon material, wherein a carbon material structure and a metal wire can be bonded by strong interaction and which is capable of preventing decreased electrical conductivity and mechanical properties such as elasticity, flexibility, etc. when the electric wire is used, especially when the electric wire is bent or wound, due to breakage and release of the carbon material, and a method for manufacturing the same.

The present disclosure is also directed to providing a method for manufacturing a composite electric wire structure which exhibits high safety without sheath bursting or short circuit under the use environment of the electric wire, especially when the electric wire is bent or wound, due to decreased adhesion to a sheath such as an insulating sheath, a shield, etc. without decrease in electrical conductivity or mechanical properties in commercially viable large scale.

The present disclosure is also directed to providing a composite electric wire structure having improved alternating current (AC) conductivity, solderability, tan delta, crazing property, elongation, corrosion resistance, etc.

In an aspect, the present disclosure provides a composite electric wire structure including: a metal wire; and a carbon material island structure present on the surface of the metal wire, wherein the carbon material island structure includes a plurality of carbon material flakes dispersed and isolated on a surface of the metal wire.

In example embodiments, the composite electric wire structure further comprises a sheath covering the metal wire and the carbon material island structure, wherein the sheath contacts with the metal wire at a portion where the carbon material island structure is not present and contacts with a carbon material at a portion where the carbon material island structure is present.

In example embodiments, the carbon material may be graphene.

In example embodiments, the carbon material flakes may be present on 5-90% of the total area of the metal wire.

In example embodiments, the carbon material flakes may have grown on the surface of the metal wire.

In example embodiments, the carbon material flakes may comprise carbon material flakes that have grown from a metal grain boundary of the metal wire.

In example embodiments, the carbon material flakes may further comprise carbon material flakes that have grown from grains of the metal wire.

In example embodiments, the carbon material flakes may comprise carbon material flakes doped with heterogeneous elements.

In example embodiments, the carbon material flakes may further comprise an externally derived carbon in addition to polymer-derived carbon.

In example embodiments, the carbon material flakes may have a thickness of 0.3-30 nm.

In example embodiments, the composite electric wire structure may be a single strand or an aggregate of a plurality of single strands.

In example embodiments, the single-strand composite electric wire structure may have a diameter of 10 nm to 100 cm.

In example embodiments, the composite electric wire structure may exhibit 1% or more increase in electrical conductivity as compared to that of a metal wire wherein the carbon material island structure is not formed.

In example embodiments, the composite electric wire structure may have an elasticity of 0.1-1000 GPa.

In example embodiments, the composite electric wire structure may exhibit 1% or less decrease in at least one of electrical conductivity and elasticity when it is deformed from a linear state.

In example embodiments, the metal may be a single crystalline metal or a polycrystalline metal.

In example embodiments, the metal may be one or more selected from a group consisting of a transition metal, a non-transition metal, a post-transition metal or an alloy thereof, In example embodiments, the transition metal may be one or more selected from a group consisting of Pt, Ru, Cu, Fe, Ni, Co, Pd, W, Ir, Rh, Sr, Ce, Pr, Nd, Sm and Re, the non-transition metal may be one or more selected from a group consisting of Mg, B, Sn and Al, and the post-transition metal may be one or more selected from a group consisting of Sn, Al and Pb.

In example embodiments, the metal wire may be a multi-layered metal wire having a multi-layered structure.

In example embodiments, the sheath may comprise an insulating sheath.

In example embodiments, the metal wire may be surface-treated.

In another aspect, the present disclosure provides a method for manufacturing a composite electric wire structure, which comprises forming graphene on a surface of a metal wire such that a carbon material island structure is formed on the surface of the wire, wherein the carbon material island structure comprises carbon material flakes dispersed and isolated on the surface of the metal wire.

In example embodiments, the method further comprises covering the metal wire and the carbon material island structure with a sheath.

In example embodiments, the carbon material may be graphene.

In example embodiments, the method comprises: providing a polymer to the metal wire; and carbonizing the polymer provided to the metal wire to a carbon material by heat-treating the metal wire and the polymer, such that the carbon material island structure is formed by partially removing the polymer during the carbonization and thus exposing the metal wire.

In example embodiments, in the providing the polymer to the metal wire, the polymer is coated on the metal wire by providing a polymer solution to the metal wire and then removing a solvent.

In example embodiments, the carbon material island structure formed in the carbonizing the polymer may be controlled by selecting a coating method of the polymer solution from full coating or selective coating and controlling one or more parameter selected from a group consisting of a kind of the polymer, a molecular weight of the polymer, a polymer concentration in the polymer solution, a coating speed of the polymer solution and a drying speed of the solvent in the coated polymer solution.

In example embodiments, the polymer may be polyacrylonitrile, a polymer of intrinsic microporosity (PIM), polyimide (PI), lignin, rayon, pitch or a mixture thereof.

In example embodiments, the polyacrylonitrile has a weight-average molecular weight of 800,000 or less, the polymer of intrinsic microporosity has a weight-average molecular weight of 50,000 or less, the polyimide has a weight-average molecular weight of 800,000 or less, the lignin has a weight-average molecular weight of 10,000 or less, the rayon has a weight-average molecular weight of 10,000 or less and the pitch has a weight-average molecular weight of 10,000 or less.

In example embodiments, the polymer layer coated on the metal wire has a thickness of 1-60 nm when full coating is employed, and the polymer layer coated on the metal wire has a thickness of 1-200 nm when selective coating is employed.

In example embodiments, the concentration of the polymer in the polymer solution may be controlled to 0.1-7 wt % when full coating is employed, and the concentration of the polymer in the polymer solution may be controlled to 0.5-10 wt % when selective coating is employed.

In example embodiments, the method may further comprise, before the providing the polymer to the metal wire, surface-treating the metal wire.

In example embodiments, the surface treatment may comprise heat treatment at or below the melting point of the metal; chemical surface treatment using an alkaline solution or an acidic solution; or physical surface treatment using plasma, ion beam, radiation, UV or microwaves.

In example embodiments, the metal wire may be partially surface-treated.

In example embodiments, the method may further comprise, after the providing the polymer to the metal wire, stabilizing the polymer.

In example embodiments, the stabilization may comprise: heat-treating the polymer at 400° C. or below before the carbonization; inducing chemical stabilization using an alkaline aqueous solution or an alkaline organic solution; inducing stabilization using plasma, ion beam, radiation, UV or microwaves; or inducing stabilization by changing the polymer chain structure or chemically crosslinking the polymer chain by reacting the polymer with a comonomer.

In example embodiments, the heat treatment may be performed at 400-1800° C. under gas atmosphere or vacuum atmosphere.

In example embodiments, the heat treatment may be performed while injecting a doping gas containing heterogeneous elements.

In example embodiments, the heat treatment may be performed while injecting a gas containing carbon atoms.

According to the composite electric wire structure and a method for manufacturing the same of example embodiments of the present disclosure, wherein a carbon material layer is not simply formed on a metal wire but the structure of the carbon material formed on the metal wire is controlled, the problems occurring during use of the composite electric wire containing a carbon material and a metal, i.e., the safety problem and decrease in electrical properties, mechanical properties, etc. can be resolved.

That is to say, when a sheath such as an insulating sheath, a shield, etc. is formed, the sheath can be uniformly bonded not only to the carbon material but also to the metal electric wire and the adhesion force is not decreased. Accordingly, the composite electric wire structure exhibits high safety under the use environment of the electric wire, especially when the electric wire is bent or wound, without sheath bursting, short circuit, decreased shielding property, etc.

In addition, the carbon material and the metal wire can be bonded by strong interaction in the composite electric wire structure and decrease in electrical conductivity and mechanical properties such as elasticity, flexibility, etc. can be prevented when the electric wire is used, especially when the electric wire is bent or wound, because breakage or release of the carbon material can be prevented. Furthermore, the composite electric wire structure can be produced in commercially viable large scale.

In addition, a composite electric wire structure having improved alternating current (AC) conductivity, solderability, tan delta, crazing property, elongation, corrosion resistance, etc. may be provided.

BRIEF DESCRIPTION OF THE DRAWINGS

The above and other aspects, features and advantages of the disclosed example embodiments will be more apparent from the following detailed description taken in conjunction with the accompanying drawings in which:

FIG. 1A schematically shows graphene coated on a metal wire according to the KR Patent Application Publication 2013-58389 (FIG. 2 of the KR Patent Application Publication 2013-58389) and FIG. 1B shows the actual image of graphene coated on a metal wire according to the KR Patent Application Publication 2013-51418 (FIG. 5 of the KR Patent Application Publication 2013-51418).

In FIG. 7, the x-axis indicates a pristine copper wire (Pristine) of Comparative Example 1 and the concentration of a polymer solution of Example 2, and the y-axis indicates electrical conductivity (unit: $10^5$ S/cm).

In FIG. 10, the x-axis indicates the diameter of the copper wire used in Example 3 (Graphene) or Comparative Example 1 (Pristine, Annealed), and the y-axis indicates electrical conductivity (unit: $10^5$ S/cm).

In FIG. 11, the x-axis indicates a pristine copper wire of Comparative Example 1 and the graphene/copper composite electric wire structure of Example 4, and the y-axis indicates electrical conductivity (unit: $10^5$ S/cm).

In FIG. 13, the x-axis indicates the carbonization time of the pristine copper wire of Comparative Example 1 and the graphene/copper composite electric wire structure of Example 4, and the y-axis indicates modulus (unit: GPa).

In FIG. 14, the x-axis indicates the carbonization time of a pristine copper wire of Comparative Example 1 and the graphene/copper composite electric wire structure of Example 4, and the y-axis indicates elongation (unit: %).

DETAILED DESCRIPTION

Figure 1A:
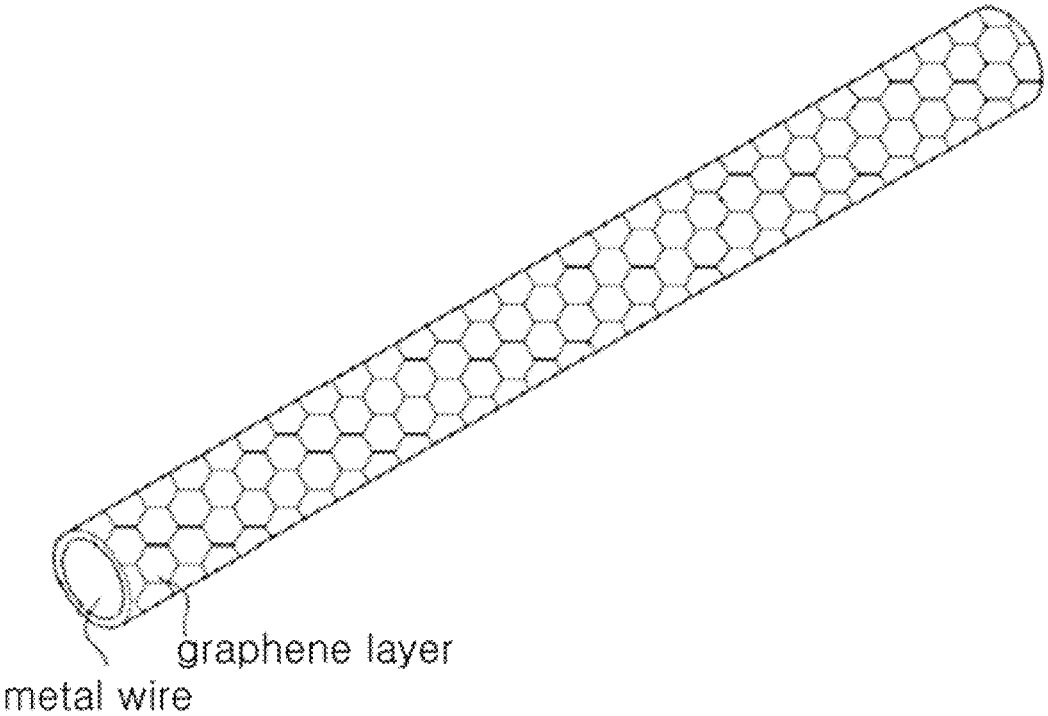
FIGS. 1A and 1B schematically show the structure of graphene formed on a metal wire according to prior art.

Example embodiments are described more fully hereinafter. The invention may, however, be embodied in many different forms and should not be construed as limited to the example embodiments set forth herein. Rather, these example embodiments are provided so that this disclosure will be thorough and complete, and will fully convey the scope of the invention to those skilled in the art. In the description, details of features and techniques may be omitted to more clearly disclose example embodiments.

The terminology used herein is for the purpose of describing particular embodiments only and is not intended to be limiting of the invention. As used herein, the singular forms "a," "an" and "the" are intended to include the plural forms as well, unless the context clearly indicates otherwise. Furthermore, the use of the terms a, an, etc. do not denote a limitation of quantity, but rather denote the presence of at least one of the referenced item. The terms "first," "second," and the like do not imply any particular order, but are included to identify individual elements. Moreover, the use of the terms first, second, etc. do not denote any order or importance, but rather the terms first, second, etc. are used to distinguished one element from another.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

In the present disclosure, a carbon material means a cyclic carbon structure having a planar (two-dimensional) structure. The carbon material may include hexagonal graphene and may also include two-dimensional carbon materials with low crystallinity as well as the graphene (That is to say, non-hexagonal, polygonal carbon structures, cyclic carbon structures having defects or amorphous carbon may be included in addition to graphene). The carbon material may be formed of graphene only.

In the present disclosure, a carbon material flake means a flake-shaped carbon material present on a surface of a metal wire.

In the present disclosure, a graphene flake means a flake-shaped graphene present on a surface of a metal wire. A plurality of hexagonal rings may be present in the graphene flake.

In the present disclosure, a carbon material island structure means an isolated island structure (or a discontinuous dot structure) of carbon material flakes wherein carbon material flakes are dispersed and isolated on the surface of a wire.

In the present disclosure, a graphene island structure means an isolated island structure (or a discontinuous dot structure) of graphene flakes wherein graphene flakes are dispersed and isolated on the surface of a wire.

In the present disclosure, a defect site means a grain boundary of a polycrystalline metal.

In the present disclosure, a polymer-derived carbon means that a carbon atom of a polymer provided to a metal wire, which forms a carbon material. That is to say, it refers that a carbon atom derived from decomposition of the polymer forms, e.g. a carbon material such as graphene or a its layered structure.

In the present disclosure, an externally derived carbon means a carbon atom provided not from the polymer but from a different carbon source (e.g., a carbon atom-containing gas), which forms a carbon material.

In the present disclosure, a sheath means a sheath such as an insulating sheath, a shield, etc. which contacts with a conductor (a metal wire or a conductor wherein a carbon material such as graphene is formed on a metal wire) in an electric wire.

Hereinafter, example embodiments of the present disclosure are described in detail.

In the present disclosure, a composite electric wire is manufactured from a metal and a carbon material, such that a carbon material layer is not simply formed on a metal wire but the structure of the carbon material formed on the metal wire is controlled to form an island structure of carbon material flakes on the surface of the metal wire.

The carbon material is mainly formed of graphene, although non-hexagonal, polygonal carbon structures, cyclic carbon structures having defects or amorphous carbon with decreased crystallinity may be included partially. Also, it may be formed of graphene only. Hereinafter, the structure is described with graphene as an example of the carbon material.

Figure 2A:
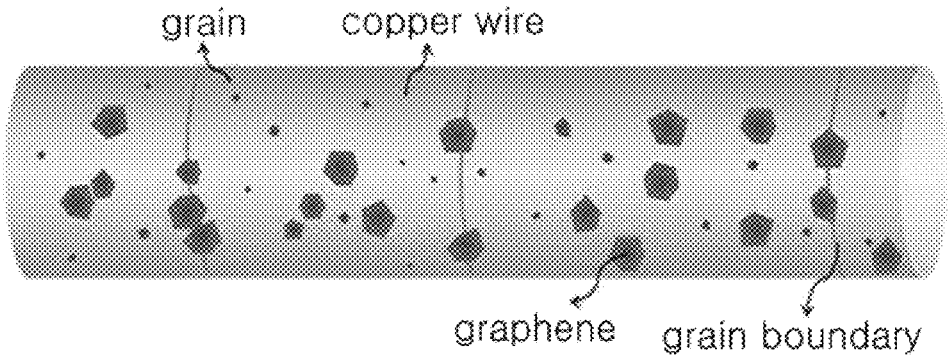
FIG. 2A schematically shows a composite electric wire structure according to an example embodiment of the present disclosure and FIG. 2B schematically shows a composite electric wire structure wherein a sheath such as an insulator is coated on the structure of FIG. 2A.
Figure 2B:
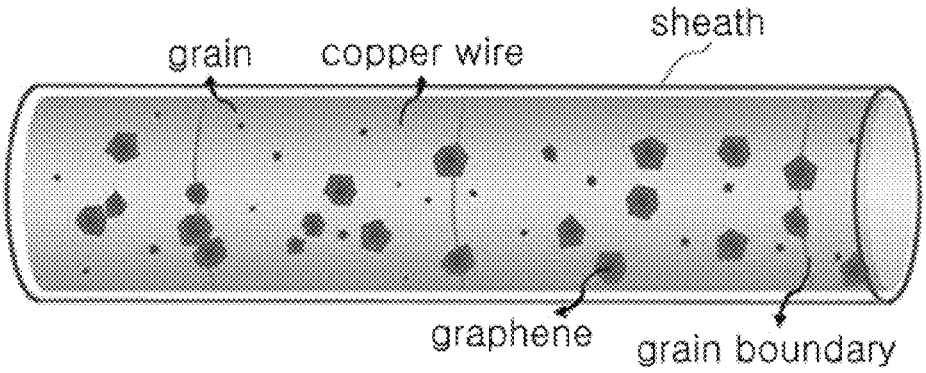

FIG. 2A schematically shows a composite electric wire structure according to an example embodiment of the present disclosure and FIG. 2B schematically shows a composite electric wire structure wherein a sheath such as an insulator is coated on the structure of FIG. 2A.

As seen from FIG. 2A, the composite electric wire formed of graphene and a metal has a graphene island structure wherein graphene flakes are sparsely (discretely) dispersed (or distributed) and isolated on a metal wire.

Figure 1B:
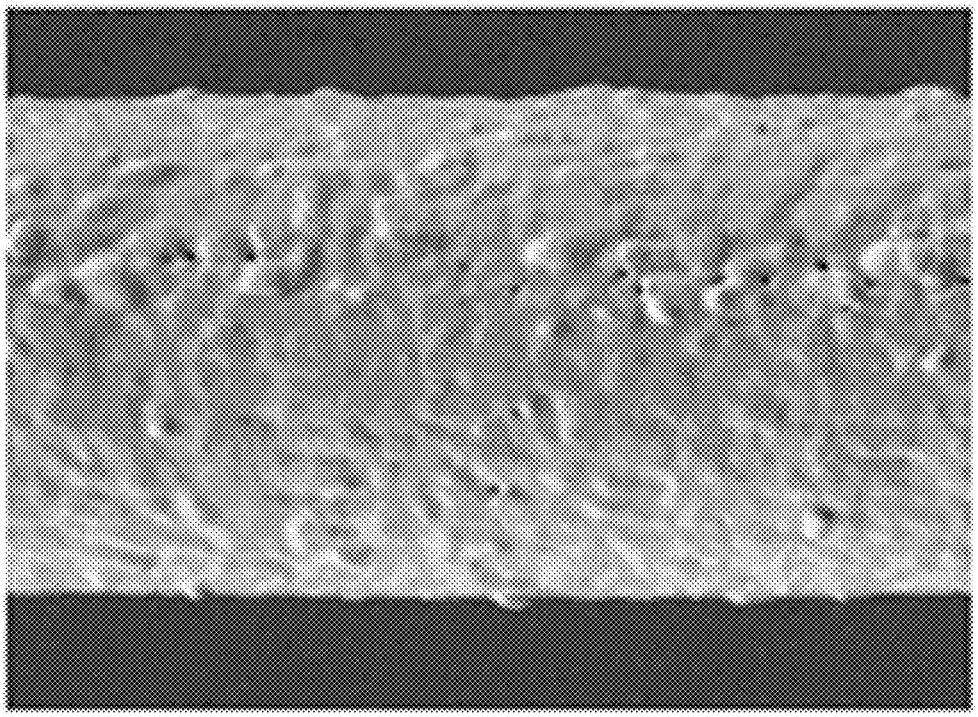
Figure 4:
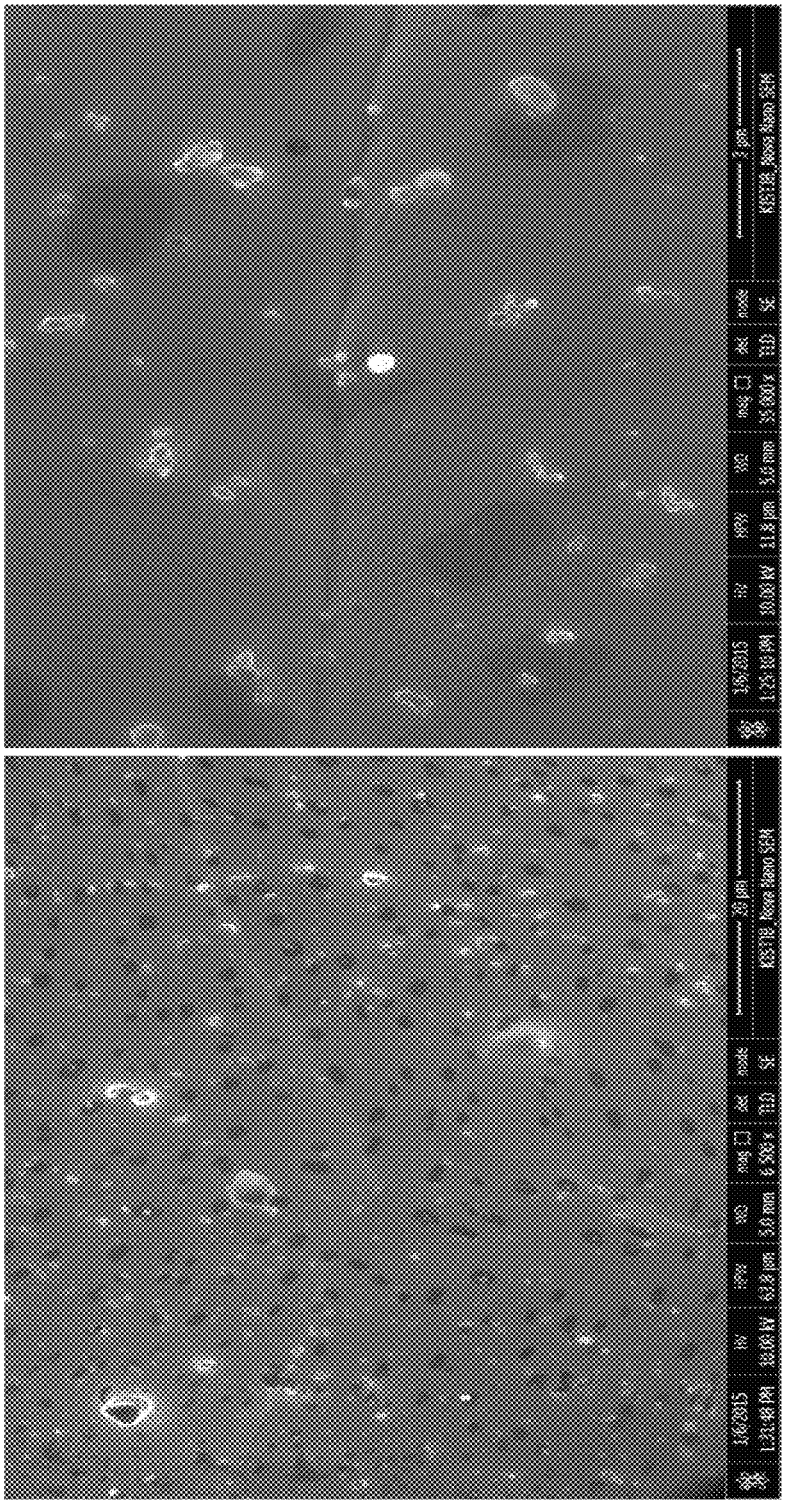
FIG. 4 shows SEM images showing the structure of a graphene/copper composite electric wire structure manufactured by conducting carbonization for 60 minutes in Example 1.

The actual image of the graphene island structure is shown in FIG. 4. Referring to FIG. 4 and FIG. 2A together, it can be seen that graphene flakes are dispersed like dots on the surface of the metal wire and the dispersed flakes are isolated from each other to form an island structure. This island structure (also called a discontinuous dot structure) is distinctly differentiated from a graphene layer formed on a metal wire according to the prior art, as shown in FIG. 1. That is to say, the graphene layer formed on the metal wire according to the prior art has a continuous structure which entirely covers the metal wire. From the actual image of FIG. 1B, it can be seen that the graphene layer is thickly coated on the metal wire (this can be expressed as a continuous planar structure of graphene).

In contrast, the composite electric wire according to an example embodiment of the present disclosure has an island structure of graphene flakes on the metal wire. The island structure is not a structure wherein a graphene layer is coated on a metal wire (continuous planar structure) but a discontinuous dot-shaped structure wherein graphene flakes are present sparsely on the metal wire. As schematically shown in FIG. 2A, some of the flakes may be attached to each other but these attached flakes (or aggregate of flakes) also exhibit an island structure (discontinuous dot structure) isolated from other flakes.

In an example embodiment of the present disclosure, a sheath such as an insulator is coated on the composite electric wire structure having such a structure.

FIG. 2B schematically shows a composite electric wire structure wherein a sheath such as an insulator (e.g., an insulating polymer such as insulating rubber, plastic, etc.) is coated on the wire of FIG. 2A. As seen from FIG. 2B, because the graphene is not present continuously on the entire surface of the metal wire but is formed to have an island structure, the sheath such as the insulator may contact directly with the metal at a portion where the graphene is not present and may contact with the graphene at other portions. Accordingly, decrease in adhesion can be prevented because the area at which the graphene contacts directly with the sheath such as the insulator is minimized, while ensuring the improvement in electrical conductivity or mechanical properties that can be achieved by the presence of the graphene on the metal wire.

Also, because the sheath such as the insulator contacts directly with the metal at a portion where the graphene is not present, sheath bursting can be prevented during the use of the composite electric wire (especially when the electric wire is bent or wound or external force is applied to the electric wire otherwise) and short circuit due to decreased insulation can be prevented. If the graphene is coated on the metal wire with a continuous planar structure, stress may be exerted to the graphene during the use of the electric wire (especially when the electric wire is bent or wound or external force is applied to the electric wire otherwise), resulting in breakage of the graphene and release from the wire. As a result, the composite electric wire may exhibit decrease in electrical conductivity and mechanical properties such as elasticity, flexibility, etc. as well as nonuniform properties. In contrast, in the island structure according to the example embodiment of the present disclosure, low stress exerted to the graphene because the graphene flakes are present sparsely. As a result, breakage and release of the graphene can be prevented under the use environment of the electric wire and, hence, the decrease in electrical conductivity and mechanical properties such as elasticity, flexibility, etc. can be prevented and the nonuniform properties of the composite electric wire can also be prevented.

In an example embodiment, the carbon material flakes (graphene flakes) may be present on 5-90%, specifically 5-50%, more specifically 20-50%, of the total area of the metal wire. These carbon material flakes (graphene flakes) do not form a continuous planar structure in any part of the metal wire. As described above, if the carbon material (graphene) contacts the insulator in a state forming a continuous planar structure, decreased adhesion, sheath bursting and short circuit may occur at the corresponding portion.

In an example embodiment, the carbon material flakes (graphene flakes) may have grown on the surface of the metal wire.

In an example embodiment, the metal wire may be a single crystalline metal wire formed of a single crystalline metal.

In an example embodiment, the metal wire may be a polycrystalline metal wire having defect sites and the carbon material flakes (graphene flakes) may have grown from the defect sites.

Because a polycrystalline metal wire show different graphene growth rate at the defect sites such as the grain boundary and the grains, graphene having an island structure may be formed easily.

Referring again to FIG. 2A and FIG. 4, a linear interface is observed between metal grains. This grain boundary acts as the defect sites. In the metal wire having such metal defect sites (metal grain boundary), graphene grows preferably at the defect sites. That is to say, a large number of metal atoms are exposed at the defect sites and, hence, graphene is formed faster from the polymer as compared to other portions. Accordingly, these defect sites may serve as major growth sites of graphene flakes. Some graphene flakes can grow also from the metal grains. When the graphene flakes are grown on the metal wire simultaneously, an island structure (discontinuous dot structure) of the graphene flakes can be obtained. Although a few graphene flakes can be joined to form a larger flake, the resulting flake should be isolated from other flakes to form an island structure.

In an example embodiment, the carbon material flakes (graphene flakes) may include carbon material flakes (graphene flakes) doped with heterogeneous elements.

In an example embodiment, the carbon material flakes (graphene flakes) may further contain externally derived carbon (carbon derived from an additionally supplied carbon source, e.g., a carbon atom-containing gas) in addition to polymer-derived carbon (carbon contained in a polymer).

In an example embodiment, the carbon material flakes (graphene flakes) may have a thickness of 0.3-30 nm.

In an example embodiment, the electric wire may be a single strand and the single-strand electric wire may be used in plural numbers (e.g., as twisted strands). As a non-limiting example, the single-strand electric wire may have a diameter of 10 nm to 100 cm.

In an example embodiment, the composite electric wire structure wherein the carbon material island structure has been formed may exhibit 1% or more, specifically 3% or more, more specifically 5% or more, more specifically 10% or more, increase in electrical conductivity as compared to that of a metal wire wherein the carbon material island structure is not formed. For example, a copper wire has an electrical conductivity of $5.6\times10^5$ S/cm. As a non-limiting example, when a carbon material island structure is formed, the electrical conductivity of the copper wire may be increased to about $5.8\text{-}6.01\times10^5$ S/cm. As another non-limiting example, the electrical conductivity of an aluminum wire, $3\times10^5$ S/cm, may be increased to $4\times10^5$ S/cm when a carbon material island structure is formed. Because an electrical wire contains a very large amount of metal, the increase in electrical conductivity by 1% or more, 3% or more, 5% or more or 10% or more is a significant increase.

In an example embodiment, the composite electric wire structure may have an elasticity of 0.1-1000 GPa, specifically 50-1000 GPa.

In an example embodiment, the electric wire is used as being bent or wound (i.e., being deformed from a linear state) and, even when it is deformed from a linear state, it may not exhibit a significant decrease in electrical conductivity and elasticity. That is to say, the electrical conductivity and/or elasticity may be changed within 1.0%.

In an example embodiment, the polycrystalline metal may be one or more selected from a group consisting of a transition metal, a non-transition metal, a post-transition metal or an alloy thereof. For example, the transition metal may be one or more selected from a group consisting of Pt, Ru, Cu, Fe, Ni, Co, Pd, W, Ir, Rh, Sr, Ce, Pr, Nd, Sm and Re. The non-transition metal may be one or more selected from a group consisting of Mg and B. The post-transition metal may be one or more selected from a group consisting of Sn, Al and Pb.

In an example embodiment, the metal wire may have a multi-layered structure. As a non-limiting example, the multi-layered metal wire may have a structure of copper (outer)/aluminum (inner), tin (outer 2)/copper (outer 1)/aluminum (inner).

In an example embodiment, the sheath which is contacted with the metal wire having the carbon material island structure formed may be a conductor shield and/or an insulator. Although the electric wire can be varied significantly in constitution depending on applications, the sheath which is contacted with the metal wire having the carbon material island structure formed is included in the sheath defined in the present disclosure.

In an example embodiment, the insulator may also be formed directly on the conductor (or the metal wire having the carbon material island structure formed according to an example embodiment of the present disclosure) without the conductor shield.

In another example embodiment, the insulator may be formed of a plurality of layers, such as a first insulator and a second insulator formed on the first insulator. When the electric current flown through the electric wire or the voltage applied to the electric wire is high, the insulator may be formed of two or more layers to provide insulation.

In an example embodiment, the insulator may be formed of an insulating polymer. As a non-limiting example, the insulator may be formed of polyimide. The insulator may be synthesized from polyacrylic acid (PAA) as an as an insulator precursor. As another non-limiting example, the insulator may be formed of polyamide-imide, polyamic acid, polyester imide, etc.

In an example embodiment of the present disclosure, because the island structure of carbon material flakes is formed on the surface of the metal wire, the adhesion between the conductor and the sheath in the composite electric wire structure may be improved. In addition, alternating current (AC) conductivity, solderability, tan delta, crazing property, elongation, etc. may be improved.

The improvement in adhesion property may be confirmed, for example, by contact angle. Because the contact angle between the metal wire and the insulating polymer is very good whereas the contact angle between the carbon material and the insulating polymer is relatively low, the formation of carbon material flakes with an island structure may lead to a better contact angle and better formation of the insulator as compared to when the carbon material covers the wire entirely.

Also, when the carbon material flakes with an island structure are present on the metal wire, alternating current (AC) conductivity may be improved particularly in the range from 400 Hz to 18 GHz. In general, alternating current conductivity is more improved than direct current (DC) conductivity. It is because the skin effect by which electricity flows near the surface is higher for the alternating current.

As for solderability, the solderability is decreased when the metal wire is covered entirely with the carbon material as compared to the metal wire is used as it is. In contrast, when the carbon material flakes are formed to have an island structure, the metal wire may have a solderability similar to that of the metal wire on which the carbon material is not formed.

The tan delta characteristic is determined by observing insulation breakdown of the wire while raising temperature to 120° C. The tan delta characteristic is better as the adhesion between the wire and the insulator is stronger. Because the adhesion with the insulating sheath can be increased when the carbon material flakes with an island structure are formed on the metal wire according to an example embodiment of the present disclosure, as described above, better tan delta characteristic may also be achieved as compared to when the carbon material is coated entirely on the metal wire.

The crazing property refers to the degree of breakage of the insulator when the wire is deformed (for example, bent) and is associated with the adhesion between the wire and the insulator. Because the adhesion with the insulating sheath can be increased when the carbon material flakes with an island structure are formed on the metal wire according to an example embodiment of the present disclosure, as described above, better crazing property may also be achieved as compared to when the carbon material is coated entirely on the metal wire.

The elongation is measured by the degree of stretching when a weight is suspended at one end of the wire. As compared to when the carbon material is coated entirely on the metal wire, the elongation may be improved when the carbon material flakes with an island structure are formed on the metal wire.

The composite electric wire structure according to an example embodiment of the present disclosure as described above may be used not only for cables but also for energy devices, electronic devices (e.g., flexible electronic devices), EMI shielding, etc.

That is to say, the electric wire structure may be used for cables for, e.g., wired AC power, low-frequency wireless power, high-frequency wireless power, LAN, PC communications, device communications, RF communications/wireless power, etc.

It may also be used for energy devices. For example, it may be prepared into a one-dimensional linear-type energy device such as an electric wire and then weaved to manufacture a wearable device.

Also, the composite electric wire structure according to an example embodiment of the present disclosure may be used as a high-conductivity electric wire for highly integrated circuits of electronic devices.

In addition, the composite electric wire structure according to an example embodiment of the present disclosure may be used for EMI shielding devices for shielding against electromagnetic interference.

Next, a method for manufacturing a composite electric wire structure according to an example embodiment of the present disclosure is described in detail.

In an example embodiment, the method for manufacturing a composite electric wire structure includes: a first step of providing a polymer to a metal wire; and second step of carbonizing the polymer provided to the metal wire to a carbon material by heat-treating the metal wire and the polymer, such that a carbon material island structure is formed by partially removing the polymer during the carbonization and thus exposing the metal wire.

The method may further include: a third step of forming a sheath after the carbon material island structure has been formed on the metal wire.

Figure 3:
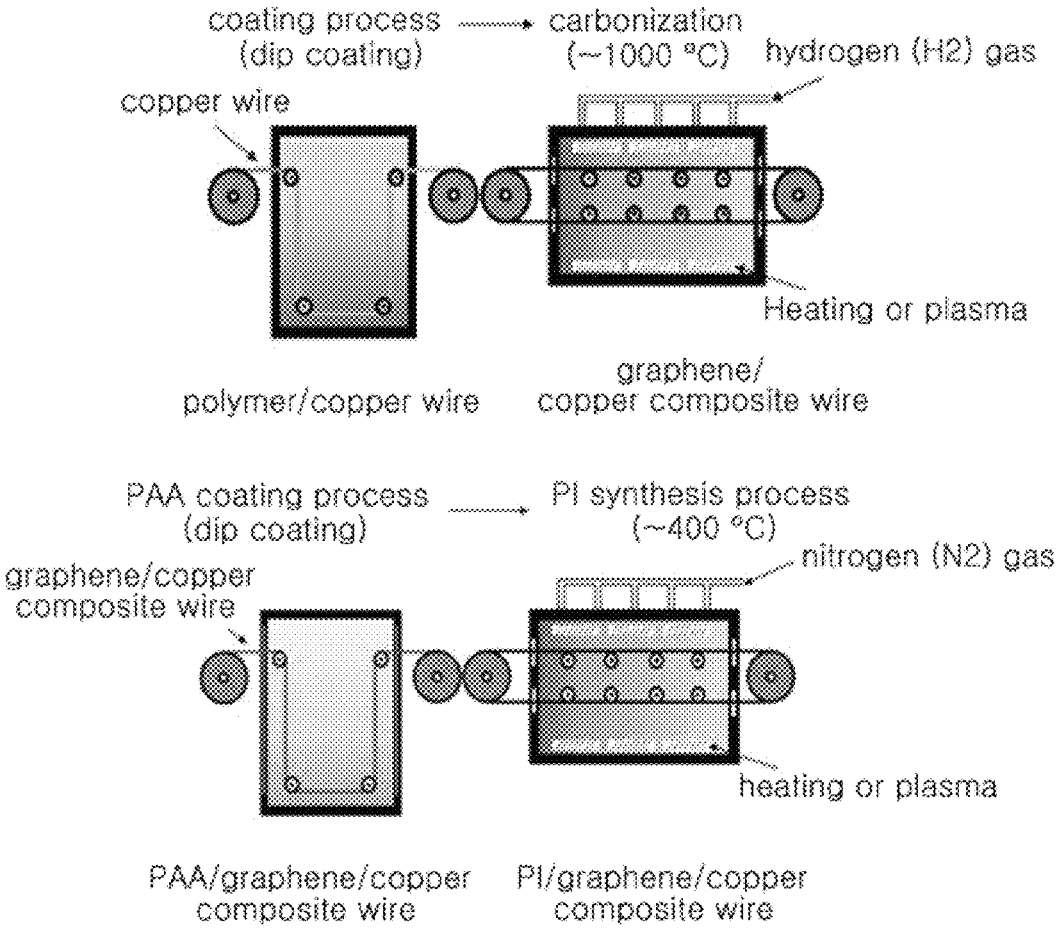
FIG. 3 schematically shows a continuous process for manufacturing a composite electric wire structure according to an example embodiment of the present disclosure.

FIG. 3 schematically shows a continuous process for manufacturing a composite electric wire structure according to an example embodiment of the present disclosure.

Referring to FIG. 3, in the first step, a polymer is coated on a metal wire by providing a polymer solution to the metal wire and then removing a solvent. Then, the polymer provided to the metal wire is carbonized into a carbon material by heat-treating the metal wire and the polymer, such that a carbon material island structure is formed by partially removing the polymer during the carbonization and thus exposing the metal wire.

The polymer coating process in the first step is controlled such that the carbon material island structure is formed by partially removing the polymer during the carbonization process and thus exposing the metal wire.

That is to say, the carbon material island structure formed in the second step is controlled (such that the metal wire is exposed) by selecting a coating method of the polymer solution from full coating or selective coating and controlling one or more parameter selected from a group consisting of the kind of the polymer, the molecular weight of the polymer, the polymer concentration in the polymer solution, the coating speed of the polymer solution and the drying speed of the solvent in the polymer solution in the first step.

Hereunder is given a more detailed description.

First, a polymer solution is provided to a metal wire in the first step.

In the first step wherein the polymer solution is provided to the metal wire, a coating method is selected from full coating or selective coating and then the kind of the polymer, the molecular weight of the polymer, the polymer concentration in the polymer solution, the coating speed of the polymer solution and the drying speed of the solvent in the polymer solution are controlled. Through this, the carbon material island structure obtained in the second step can be controlled.

When selecting the kind of the polymer, the ratio of carbon atom remaining after the carbonization, or carbonization yield, should be considered. If the carbonization yield is low, the number of the island structures may decrease or the island structure may not be formed. Therefore, the carbonization yield should be high for the graphene to grow on the metal wire while forming the island structure. However, if the carbonization yield is too high, the island structure cannot be formed because a thick graphene or graphite layer is coated on the whole surface of the wire. In this case, when deformation such as bending or winding is made as described above, the graphene may be broken due to decreased adhesion between the thick graphene layer and the wire. Also, the graphene may be released from the graphene layer except for the interface between the wire and the graphene layer due to decreased adhesion between the thick graphene layer and the wire. The released graphene may act as impurities and lead to decreased adhesion to the insulating sheath.

In an example embodiment, as the polymer, a carbon fiber-forming polymer such as polyacrylonitrile (PAN), a polymer of intrinsic microporosity (PIM), pitch, lignin, polyimide (PI), rayon, etc. may be used. In the non-limiting examples described below, the PAN polymer was used.

Also, the size of the graphene island grown on the surface of the wire may be controlled with the molecular weight of the polymer. When a polymer with a large molecular weight is used, large-sized graphene islands are formed after the carbonization. On the other hand, when a polymer with a small molecular weight is used, small-sized islands may be grown over a large area. And, if the molecular weight of the polymer is too large, the carbon material may entirely cover the wire without forming the island structure. For example, if a solution of PMMA having a molecular weight of 950,000 used in the KR Patent Application Publication 2013-51418 is used for coating, the graphene covers the whole surface of the wire without forming the island structure, as shown in FIG. 1B. Accordingly, problems such as decreased adhesion occur when an insulating sheath is formed.

As a non-limiting example, the polyacrylonitrile may have a weight-average molecular weight of 800,000 or smaller, specifically 118,000-520,000.

As a non-limiting example, the polymer of intrinsic microporosity may have a weight-average molecular weight of 50,000 or smaller.

As a non-limiting example, the pitch may have a weight-average molecular weight of 10,000 or smaller, specifically 100-1500.

As a non-limiting example, the rayon may have a weight-average molecular weight of 10,000 or smaller.

As a non-limiting example, the polyimide may have a weight-average molecular weight of 800,000 or smaller, specifically 100,000-500,000.

As a non-limiting example, the lignin may have a weight-average molecular weight of 10,000 or smaller.

Also, the thickness of the polymer layer coated on the wire may be controlled by the coating speed. When the coating speed is too low, the island structure may not be formed and the thickness of the polymer layer coated on the wire may be nonuniform. And, when the coating speed is too high, the number of the graphene islands may decrease although a thin polymer layer can be obtained.

Because the polymer is coated on the wire in solution state, a process of removing a solvent contained in the solution is necessary. When the solvent is evaporated, the evaporation speed may affect the uniformity of the coated polymer. When the drying speed of the solvent is too high, the island structure may not be formed or may be formed in small amounts because the polymer does not remain uniformly on the surface of the wire. When the drying speed is low, although a uniform polymer layer may be coated, it is not suitable for large-scale production because a long time is necessary.

The polymer may be provided onto the metal wire by full coating or selective coating.

During the full coating or selective coating, a polymer layer is formed on the metal wire and then the polymer is partially removed during carbonization to expose the metal wire. As a result, the carbon material island structure may be formed. When selective coating is employed, the polymer layer may be selectively formed on the wire as island structures and smaller island structures may be formed through carbonization.

The full coating may be performed, for example, by spin coating, dip coating, bar coating or spray coating.

The selective coating may be performed, for example, by inkjet printing, gravure printing, gravure offset printing, flexography, screen printing, nano-imprinting, etc.

For self-assembly, both full coating and selective coating may be performed.

In each coating method, the above-described polymer coating conditions (the kind of the polymer, the molecular weight of the polymer, the polymer concentration in the polymer solution, the coating speed of the polymer solution and the drying speed of the solvent in the polymer solution) are controlled. In addition, the coating process may also be affected by temperature and humidity. Because coating may not be performed well if the temperature is too high, the temperature is maintained at room temperature (20-30° C.). And, the humidity may be controlled to specifically a relative humidity of about 20% or lower. If the relative humidity is too high, holes may occur in the coating as the solvent used to dissolve the polymer is replaced with water included in the atmosphere.

The dip coating is a method of dipping in a polymer solution and may be suitable for large-scale production. The dip coating method was used in the non-limiting examples described below.

The spin coating is a method of dropping a polymer solution and then coating a thin film by spinning it. Although it may difficult to employ the spin coating method when the wire is coated by a continuous process, the spin coating method may be used in a process whereby the wire is arranged in coil shape and the polymer is coated and then carbonized. When the spin coating is employed, the characteristics of the coated polymer film may be changed by the rotation speed, in addition to the five process conditions described above. Accordingly, the rotation speed and the temperature of a rotating plate are controlled such that the island structure can be formed.

The bar coating is a method used to coat an insulating polymer (e.g., a PAA polymer) on the wire. In the bar coating, the polymer coating thickness may be controlled by controlling the distance between the wire and a bar. Also, the coating speed may be controlled by the moving speed of the wire.

The spray coating is a representative coating method. The degree of coating may be changed with the nozzle size, spraying pressure and carrier gas.

For self-assembly, the self-assembly may be induced by, after mixing two immiscible polymers, exposing the mixture to a solvent vapor capable of dissolving only one polymer and thereby increasing the fluidity of the polymer (full coating) or by dissolving and extracting only one polymer (selective coating). Alternatively, after coating a mixture of polymers, selective coating may be achieved by removing the polymer with a lower degradation temperature by applying heat. In this manner, full or selective coating is achieved by inducing self-assembly of the same polymer using a solvent, heat, etc.

The above-described dip coating, spin coating, bar coating, spray coating and self-assembly methods are method for coating the polymer on the whole surface of the wire. However, although the polymer is coated on the whole surface of the wire, it does not mean that graphene is coated on the whole surface of the wire. That is to say, although the polymer is coated on the whole surface of the wire, because the polymer is degraded as gas during the carbonization, the graphene (two-dimensional carbon material) island structure is formed if the polymer is coated to less than a predetermined thickness.

In an example embodiment, when full coating is employed, the polymer is coated to a thickness of 1-60 nm, specifically 40-60 nm. In this case, the polymer is degraded (more accurately, decomposed to smaller molecules) during the carbonization and, as a result, some of the polymer is removed as gas and some remains on the wire surface to form the graphene island structure.

In the selective coating by inkjet printing, gravure printing, gravure offset printing, flexography, screen printing, nano-imprinting or self-assembly, the polymer is partially coated. In this case, unlike the above-described methods, the island structure may be formed by regularly coating the polymer from the step of providing the polymer. In this case, because graphene is formed from the polymer layer selectively formed on the wire surface, the thickness of the polymer layer and the molecular weight of the polymer may be larger as compared to the full coating.

In an example embodiment, when selective coating is employed, the polymer layer may have a thickness of 1-200 nm, specifically 1-150 nm.

For both full coating and selective coating, the amount of the polymer which does not contact with the metal of the wire increases as the thickness of the polymer layer increases and, as a result, the proportion of the hexagonal cyclic structure may decrease and amorphous carbon may be formed. As a consequence, the electrical and mechanical properties of a composite wire may be unsatisfactory as compared to that formed of pure graphene only. In addition, for both full coating and selective coating, graphene flakes may not be formed if the thickness of the polymer layer is smaller than the above-described values.

In an example embodiment, the concentration of the polymer in the polymer solution may be controlled to 1-10 wt %.

Herein, the concentration of the polymer refers to the content of the polymer dissolved in the polymer solution. For example, if the concentration of the polymer is 5 wt %, it means that, in 100 g of the polymer solution, 5 g is the polymer and, 95 g is the solvent.

As a non-limiting example, when full coating is employed using the polymer such as PAN, PIM, PI, lignin, rayon, pitch, etc., the concentration of the polymer in the polymer solution may be 0.1-7 wt %.

As a non-limiting example, when selective coating is employed using the polymer such as PAN, PIM, PI, lignin, rayon, pitch, etc., the concentration of the polymer in the polymer solution may be 0.5-10 wt %.

In an example embodiment, the metal wire may be surface-treated before the polymer is provided to the metal wire.

Specifically, the metal wire may be surface-treated before being provided to the polymer by heat-treating at or below the melting point of the metal. When the metal is heat-treated at or below the melting point of the metal, some of the metal is evaporated and surface roughness increases. As a result, the contact area between the polymer and the metal surface is increased and adhesion between them may be enhanced. Likewise, the surface roughness of the metal may be increased before providing the polymer to the metal wire by chemically surface-treating using an alkaline solution (particularly, a strongly alkaline solution) or an acidic solution (particularly, a strongly acidic solution) or by physically surface-treating using plasma, ion beam, radiation, UV, microwaves, etc. Through this, the adhesion between the polymer and the metal wire may be enhanced and, therefore, the adhesion between the metal wire and the graphene island may be enhanced.

Specifically, in an example embodiment, the metal wire may be partially surface-treated. For example, when surface-treating the metal, the degree of surface treatment may be decreased by lowering the heat treatment temperature during the heat treatment, using a solution of a lower concentration during the chemical treatment or decreasing beam irradiation time during the physical treatment. When the metal surface is partially surface-treated in this manner, the partially surface-treated portion is more likely to form graphene flakes because the adhesion between the polymer and the metal wire is stronger at the portion. Through this surface treatment, the number, size, etc. of the graphene flakes formed on the metal wire surface can be controlled and, consequently, the graphene island structure can be controlled.

In an example embodiment, the surface-treated metal wire may have a surface roughness of 0.01-100 nm, more specifically 0.1-20 nm.

In an example embodiment, the polymer may be stabilized after the polymer has been provided to the metal wire. Herein, the stabilization means conversion of the linear polymer into a hexagonal cyclic polymer. Through this stabilization, the ratio of carbon atom remaining after the carbonization, or carbonization yield, can be improved. Also, the shape and quality of the carbon material (the quality is better as hexagonal graphene increases and pentagonal or amorphous carbon decreases) can be controlled.

Carbonization is performed at high temperature (e.g., 1000° C.). During the carbonization, graphene is formed and, at the same time, carbon atom is removed as gas. Therefore, if the polymer which is the carbon source is lost excessively, graphene may not grow uniformly. To prevent this, the polymer may be stabilized by before being heat-treated at 1000° C. Through the stabilization, the loss of the polymer which is the carbon source can be prevented and quality can also be controlled because it becomes easy to control the thickness, shape and island structure of graphene flakes.

Specifically, in an example embodiment, the PAN, pitch, rayon, etc. may be stabilized.

In an example embodiment, the stabilization may be performed by, before the heat treatment (carbonization), heat-treating the polymer at 400° C. or below under air, oxygen or vacuum atmosphere, inducing chemical stabilization using an alkaline aqueous solution (particularly, a strongly alkaline aqueous solution) or an alkaline organic solution (particularly, a strongly alkaline organic solution), or inducing stabilization using plasma, ion beam, radiation, UV or microwaves. Alternatively, the stabilization may be induced by changing the polymer chain structure or chemically crosslinking the polymer chain by reacting the polymer with a comonomer.

Next, the polymer is carbonized by heat-treating (400-1800° C.) the metal to which the polymer has been provided. Through this simple heat treatment (carbonization), graphene having an island structure can be easily provided on the metal wire.

In an example embodiment, the metal wire onto which the polymer has been provided may be heat-treated (carbonized) at 400-1800° C. under gas atmosphere of an inert gas, hydrogen, etc. or vacuum atmosphere.

In an example embodiment, in order to change the electrical properties of the composite electric wire structure, the heat treatment may be performed while injecting a doping gas (as a non-limiting example, ammonia gas may be used) containing heterogeneous elements such as nitrogen, boron, oxygen, sulfur, etc. As a result, the heterogeneous elements may be doped in the graphene of the composite electric wire structure.

In addition, in order to improve the quality of the composite electric wire structure, a carbon-containing gas such as acetylene, ethylene, methane, etc. may be injected. When the carbon-containing gas is injected, the size of graphene may increase during the carbonization or, graphene may grow additionally on the defect sites (the grain boundary of the metal) where graphene has not formed. Accordingly, the electrical conductivity/mechanical properties of the composite electric wire may be improved. Accordingly, the manufactured composite electric wire structure may contain externally derived carbon (carbon derived from an additionally supplied carbon source, e.g., the carbon atom-containing gas) in addition to polymer-derived carbon (carbon contained in the polymer) in the graphene. The additionally provided carbon may improve the quality of the carbon material by decreasing amorphous carbon or other defects.

In an example embodiment, a sheath may be formed after the island structure of the carbon material has been formed through the heat treatment. As described above, the sheath may be a shield or an insulator. A method for forming the sheath is well known in the art. For example, it may be formed by coating a sheath material and performing heat treatment.

Hereinafter, the present disclosure will be described in detail through examples. However, the following examples are for illustrative purposes only and it will be apparent to those of ordinary skill in the art that the scope of the present disclosure is not limited by the examples.

Example 1

In order to investigate the manufacturing characteristics of a graphene/copper composite electric wire structure depending on carbonization time, a copper wire with a diameter of 0.192 mm and a low-concentration polymer solution (3.0% based on the weight of a polar solvent) were prepared. The polar solvent was N,N-dimethlyformamide (DMF) and the polymer was polyacrylonitrile (PAN). The polyacrylonitrile (PAN) had a molecular weight of 150,000 and carbonization yield was 40-50%.

Full coating was performed by dip coating. Coating speed was 0.5 m/min and drying time was 0.5 hour. Coating thickness was about 50 nm.

That is to say, the copper wire was dipped in the polymer solution for several seconds and then dried for 30 minutes at 70° C. under vacuum atmosphere. During the coating, temperature was maintained at room temperature (25° C.) and relative humidity was maintained at 20%.

Subsequently, the copper wire was heated (for carbonization) for 10, 30 or 60 minutes to 1000° C. under 5 sccm hydrogen gas atmosphere. As the polymer was carbonized, an island structure of graphene flakes appeared (see, e.g., FIG. 4).

An insulator was formed on the copper wire as follows. First, a N-methyl-2-pyrrolidone (NMP) solution of PAA was coated on the copper wire having the graphene island structure formed. After the coating, heat treatment was performed to convert the PAA to PI. During the heat treatment, a PI sheath was formed as the solvent was evaporated into the air. Before loading the wire in a heat-treatment furnace, the wire was contacted with a metal bar in order to ensure uniform thickness of the formed insulating sheath. If the distance between the wire and the metal bar is maintained constant, the thickness of the coated polymer can be maintained constant. After the heat treatment (up to 400° C.), a PI insulator with a uniform thickness may be formed. If the temperature is above 400° C., the PI polymer may be converted to graphene or decomposed and removed. Therefore, the maximum temperature was set to 400° C.

Example 2

A high-conductivity graphene/copper composite electric wire was manufactured in the same manner as in Example 1, except for the diameter of the copper wire, the concentration of the polymer solution and the carbonization time. The graphene/copper composite electric wire was manufactured using a copper wire with a diameter of 0.197 mm and a 0.5, 1.5 or 3.0% polymer solution based on the weight of the polar solvent by carbonizing for 30 minutes.

Example 3

A graphene/copper composite electric wire was manufactured in the same manner as in Example 2, except for the diameter of the copper wire and the concentration of the polymer solution. The high-conductivity graphene/copper composite electric wire was manufactured using a copper wire with a diameter of 0.180, 0.192 or 0.197 mm and a 1.0% polymer solution based on the weight of the polar solvent.

Example 4

A high-conductivity graphene/copper composite electric wire was manufactured in the same manner as in Example 3, except that a copper wire with a diameter of 0.192 mm was used and carbonization was performed for 10, 20 or 30 minutes by heating to 1000° C. under 60 sccm hydrogen gas atmosphere.

Comparative Example 1

The copper wire with a diameter of 0.192 mm used in Example 3 was used without polymer coating (pristine) or after heat treatment only (annealed).

Comparative Example 2

A graphene/copper composite electric wire wherein graphene was formed on wholly on a copper wire with a diameter of 0.192 mm was manufactured via chemical vapor deposition (CVD). Specifically, the copper wire was heated to 1000° C. under 5 sccm hydrogen atmosphere and then pretreated for 15 minutes for removal of copper oxide and growth of the copper grain boundary. After the pretreatment, graphene was formed wholly on the copper wire by flowing 30 sccm methane gas as a gaseous carbon source for 30 minutes.

Comparative Example 3

A graphene/copper composite electric wire was manufactured by forming graphene wholly on a copper wire, unlike Example 1. Other conditions were the same as in Example 1. For full coating, a relatively very high-concentration polymer solution (15% based on the weight of the polar solvent) was used.

[Characterization]

FIG. 4 shows SEM images showing the structure of the graphene/copper composite electric wire structure manufactured by conducting carbonization for 60 minutes in Example 1.

As seen from FIG. 4, graphene flakes formed an island structure (discontinuous dot structure) on the copper wire in the manufactured graphene/copper composite electric wire structure. The line shown in FIG. 4 is a defect site (metal grain boundary).

Figure 5A:
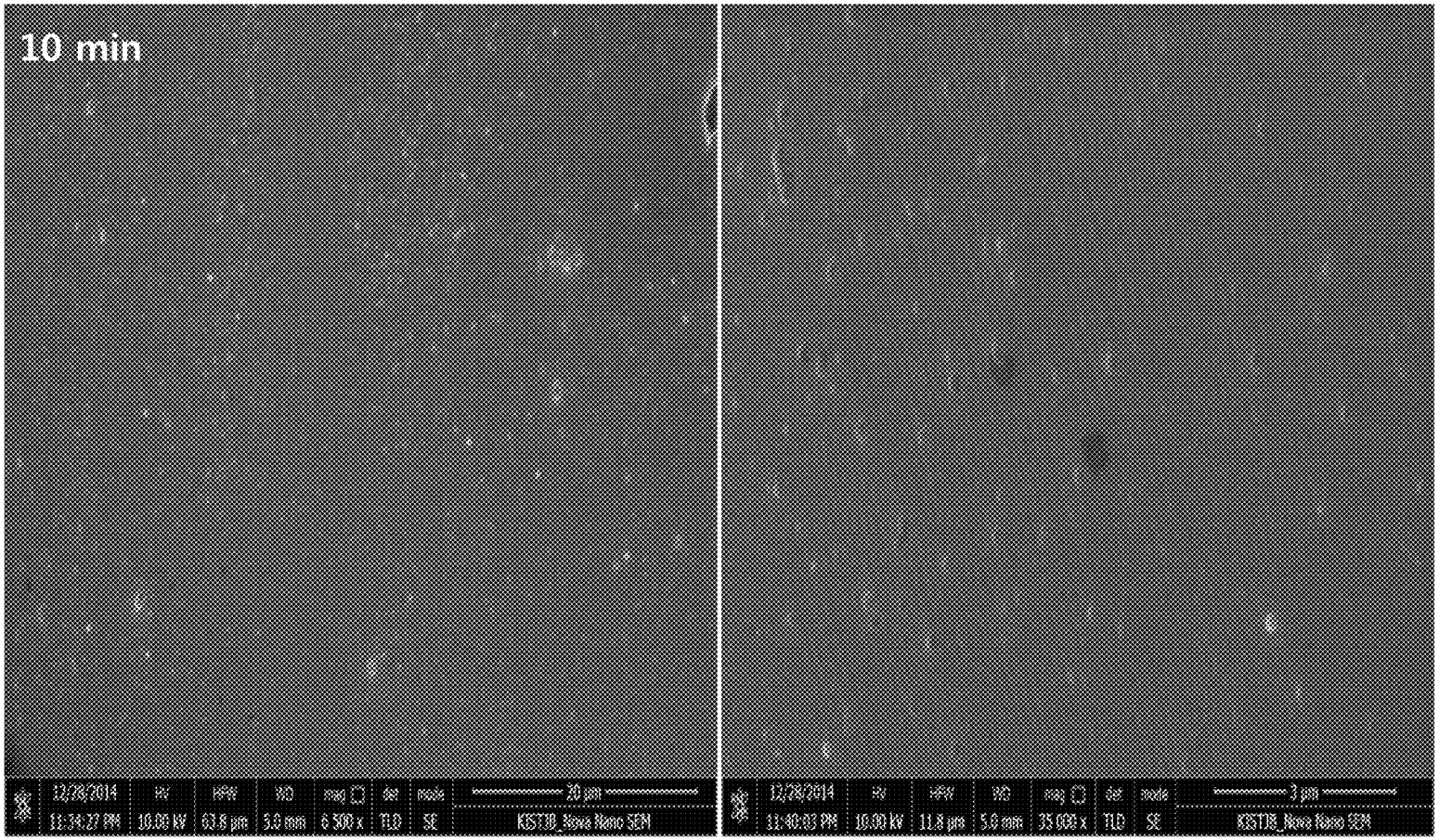
FIGS. 5A-5C are SEM images showing the surface of a graphene/copper composite electric wire structure manufactured in Example 1 with carbonization times of 10 minutes (FIG. 5A), 30 minutes (FIG. 5B) and 60 minutes (FIG. 5C).
Figure 5B:
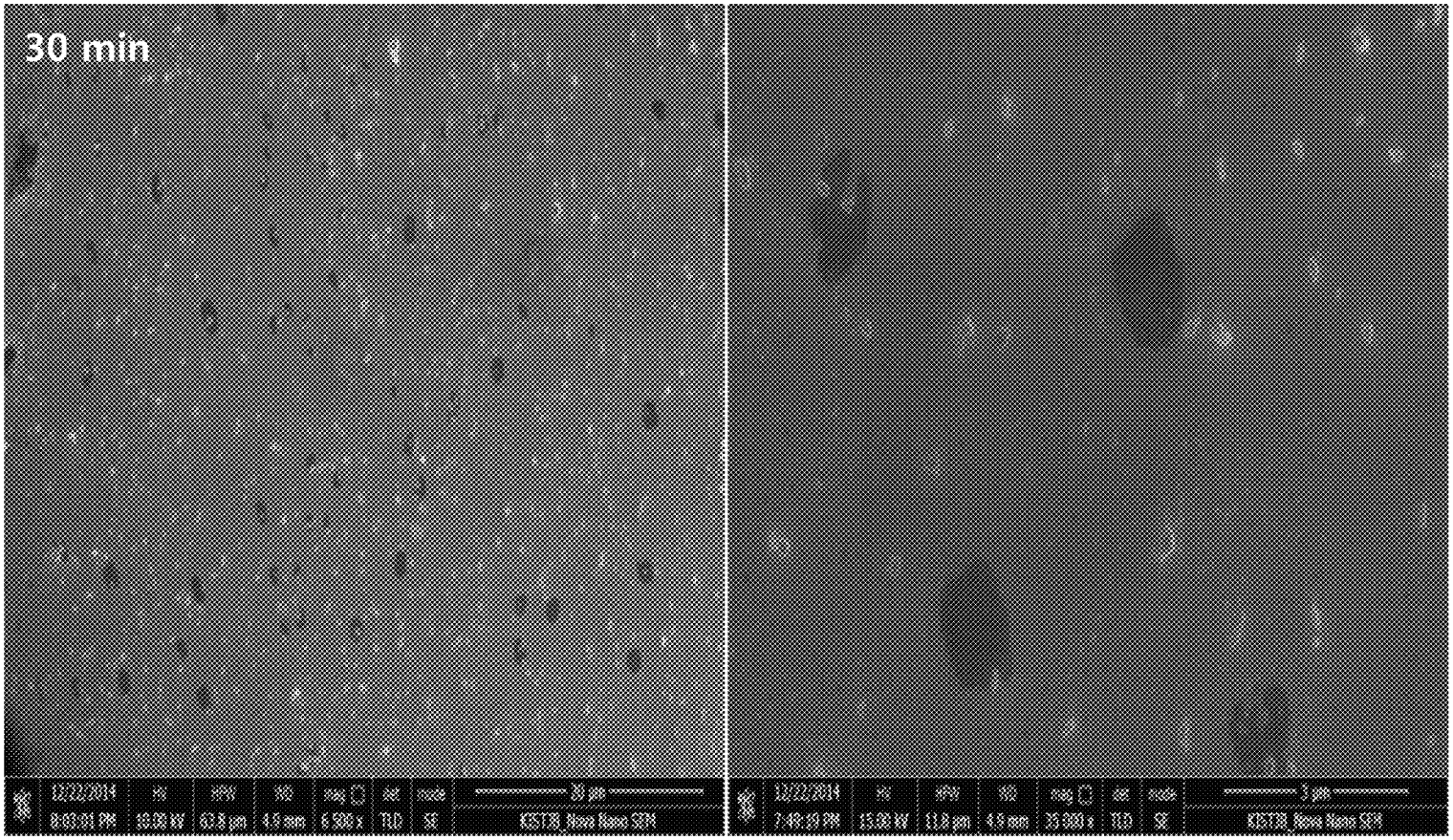
Figure 5C:
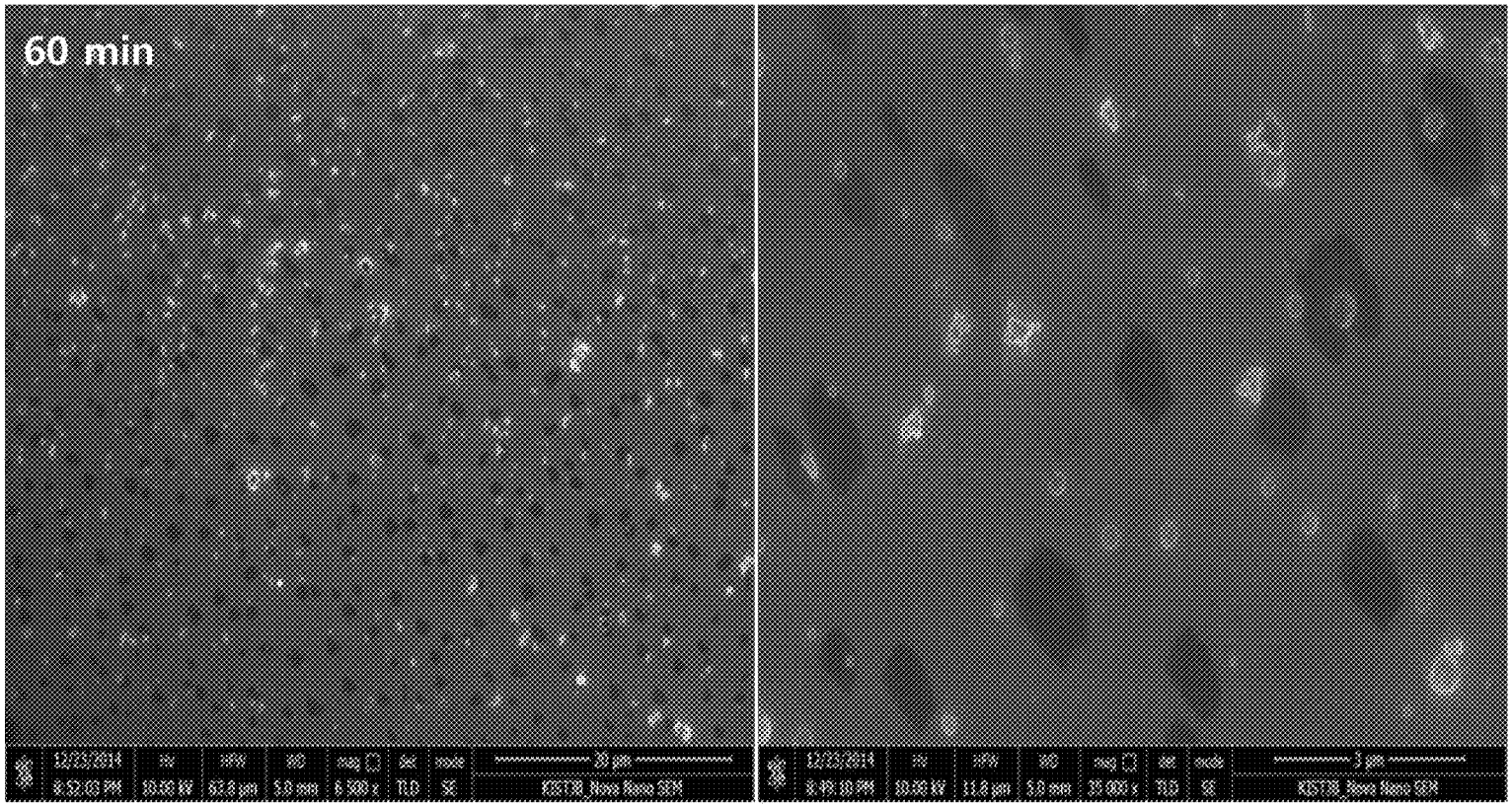

FIGS. 5A-5C are SEM images showing the surface of the graphene/copper composite electric wire structure manufactured in Example 1 with carbonization times of 10 minutes (FIG. 5A), 30 minutes (FIG. 5B) and 60 minutes (FIG. 5C).

It can be seen that the number and size of graphene flakes increase with carbonization time.

Figure 6A:
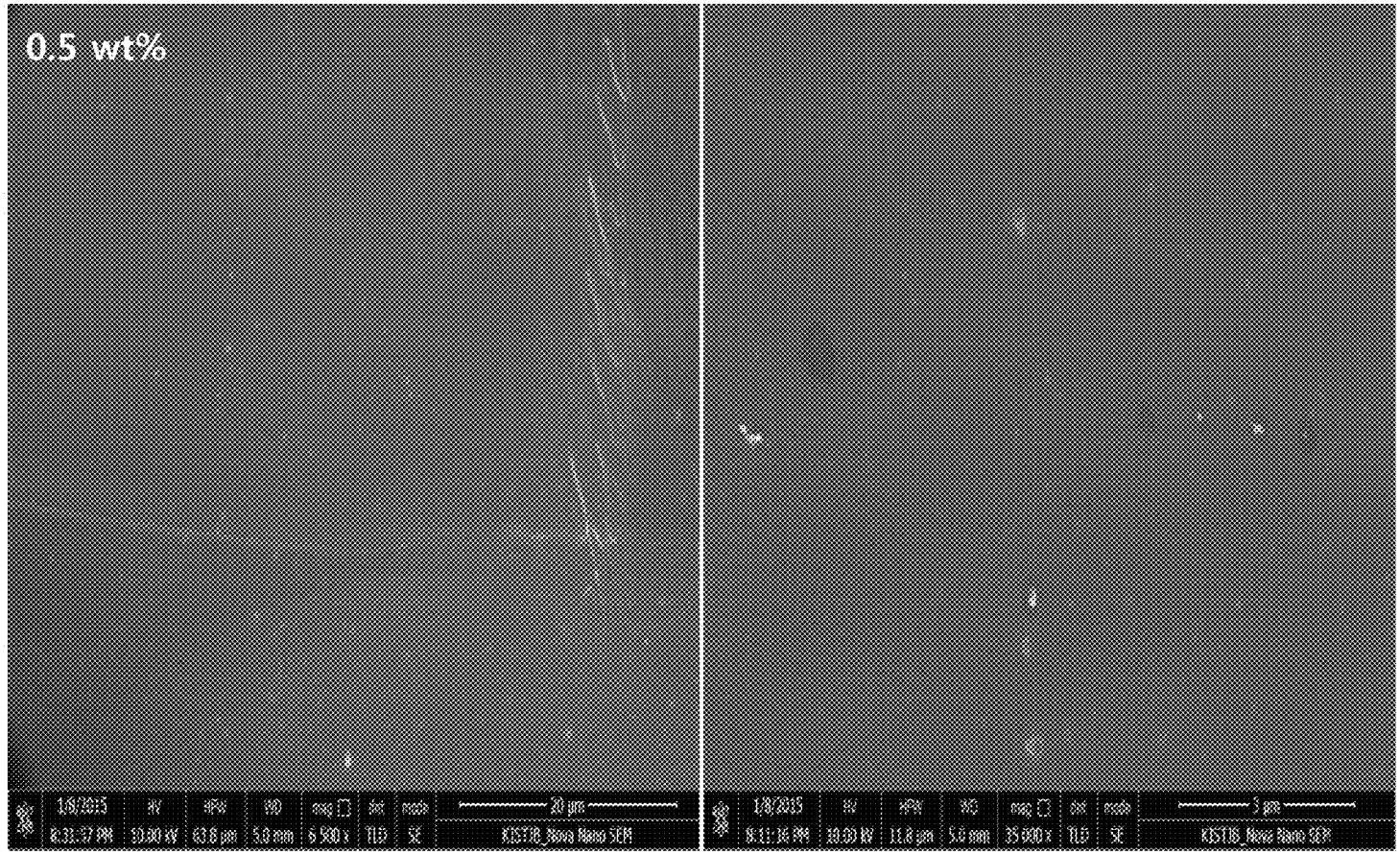
FIGS. 6A and 6B are SEM images showing the surface of a graphene/copper composite electric wire structure manufactured in Example 2 from a 0.5% (FIG. 6A) and 3.0% (FIG. 6B) polymer solution based on the weight of a polar solvent.
Figure 6B:
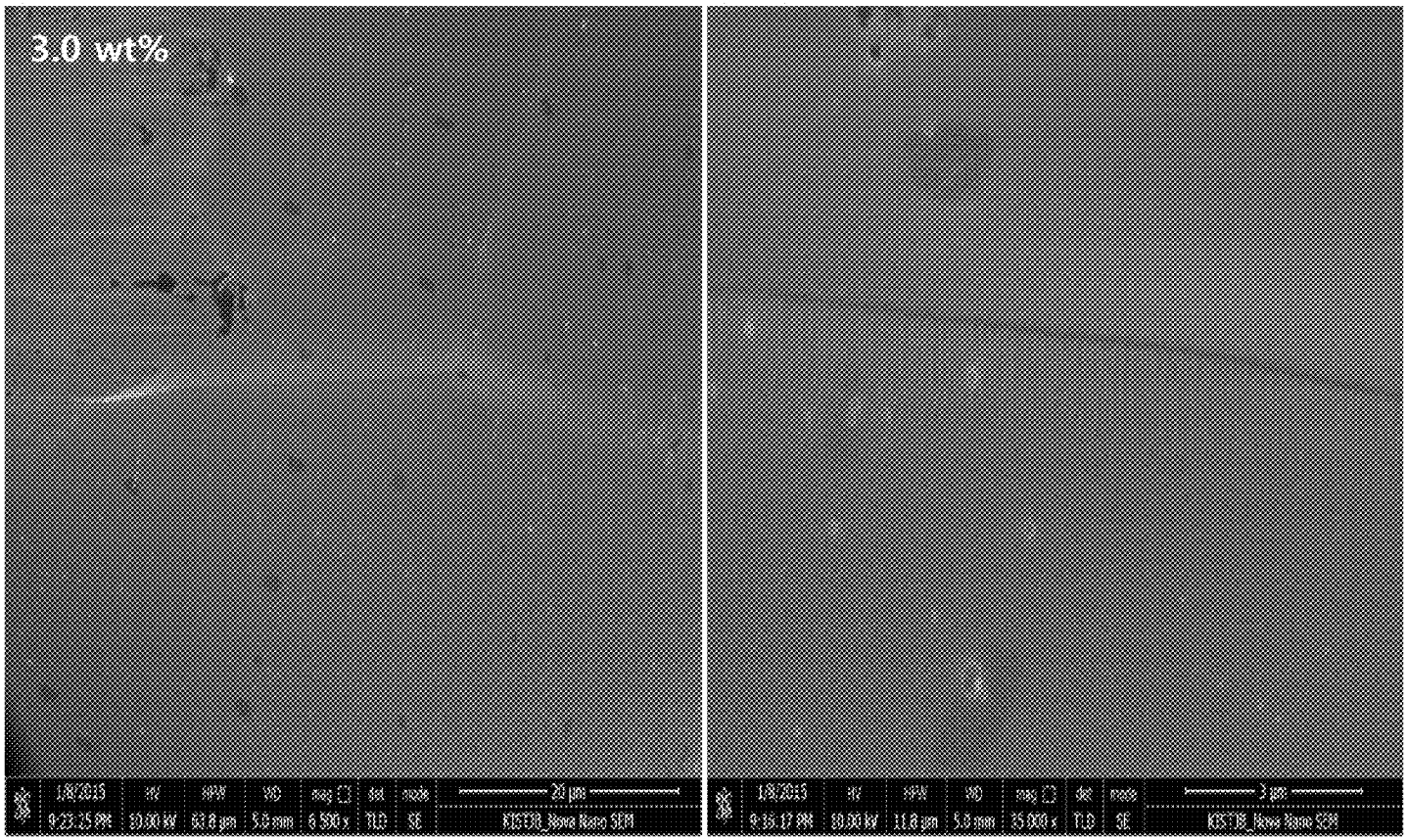

FIGS. 6A and 6B are SEM images showing the surface of the graphene/copper composite electric wire structure manufactured in Example 2 from a 0.5% (FIG. 6A) and 3.0% (FIG. 6B) polymer solution based on the weight of the polar solvent.

It can be seen that the number and size of graphene flakes increase with the concentration of the polymer solution. However, as described above, the concentration of the polymer solution should be restricted within a predetermined range for the graphene flakes to have a dispersed and isolated island structure.

Figure 7:
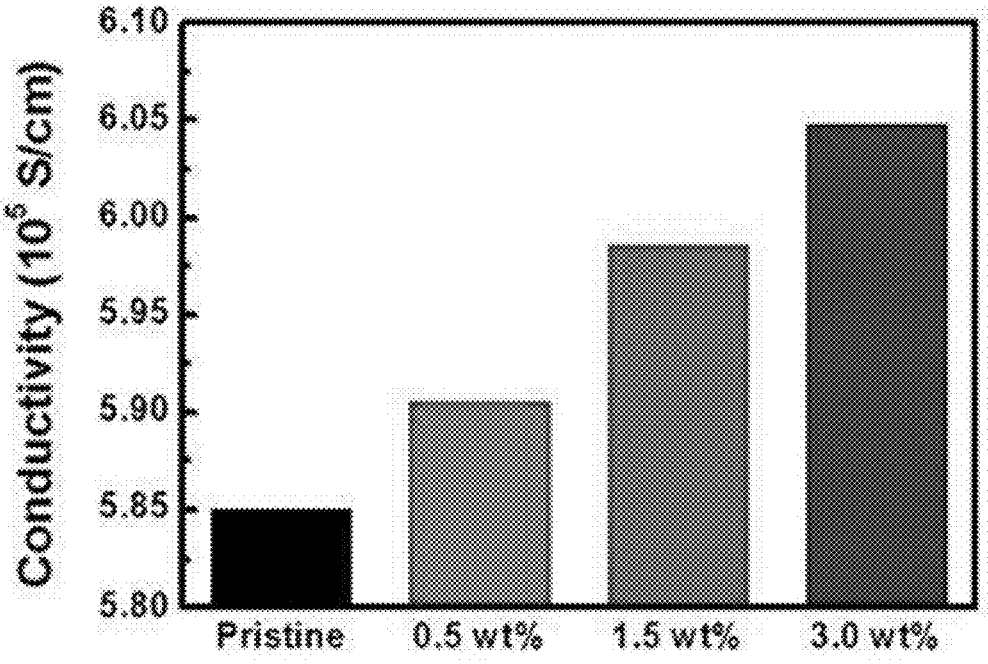
FIG. 7 shows a result of measuring electrical conductivity for Example 2 and Comparative Example 1 by the 4-point probe method.

FIG. 7 shows a result of measuring the electrical conductivity the graphene/copper composite electric wire structure manufactured in Example 2 by the 4-point probe method. In FIG. 7, the x-axis indicates the concentration of the polymer solution of Example 2 and the y-axis indicates electrical conductivity (unit: $10^5$ S/cm). In FIG. 7, the pristine copper wire (before heat treatment) not coated with the polymer solution is indicated by pristine.

Figure 8A:
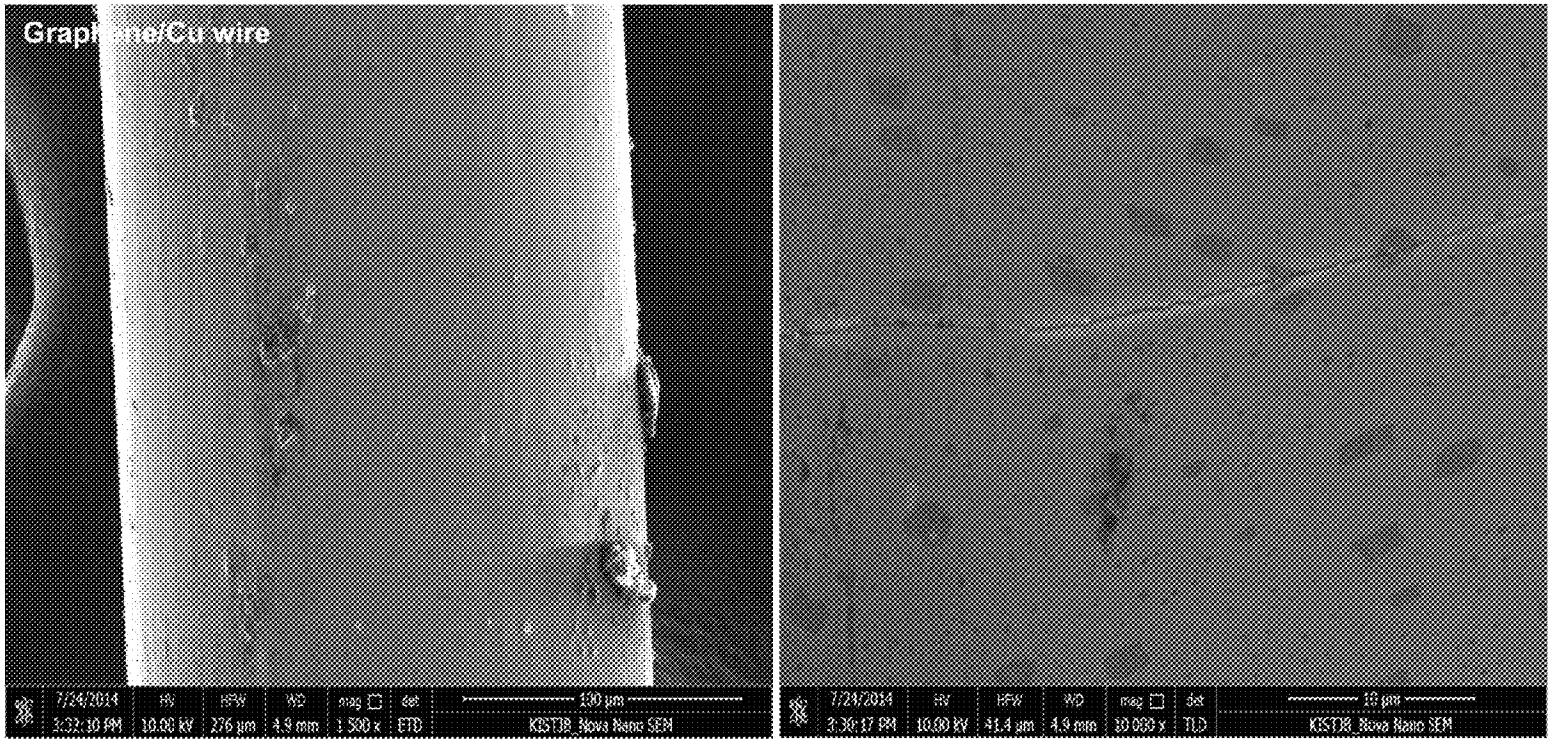
FIGS. 8A and 8B are SEM images showing the surface of a graphene/copper composite electric wire structure manufactured in Example 3 using a copper wire with a diameter of 0.192 mm (FIG. 8A) and the surface of a pristine copper wire in Comparative Example 1 (FIG. 8B).
Figure 8B:
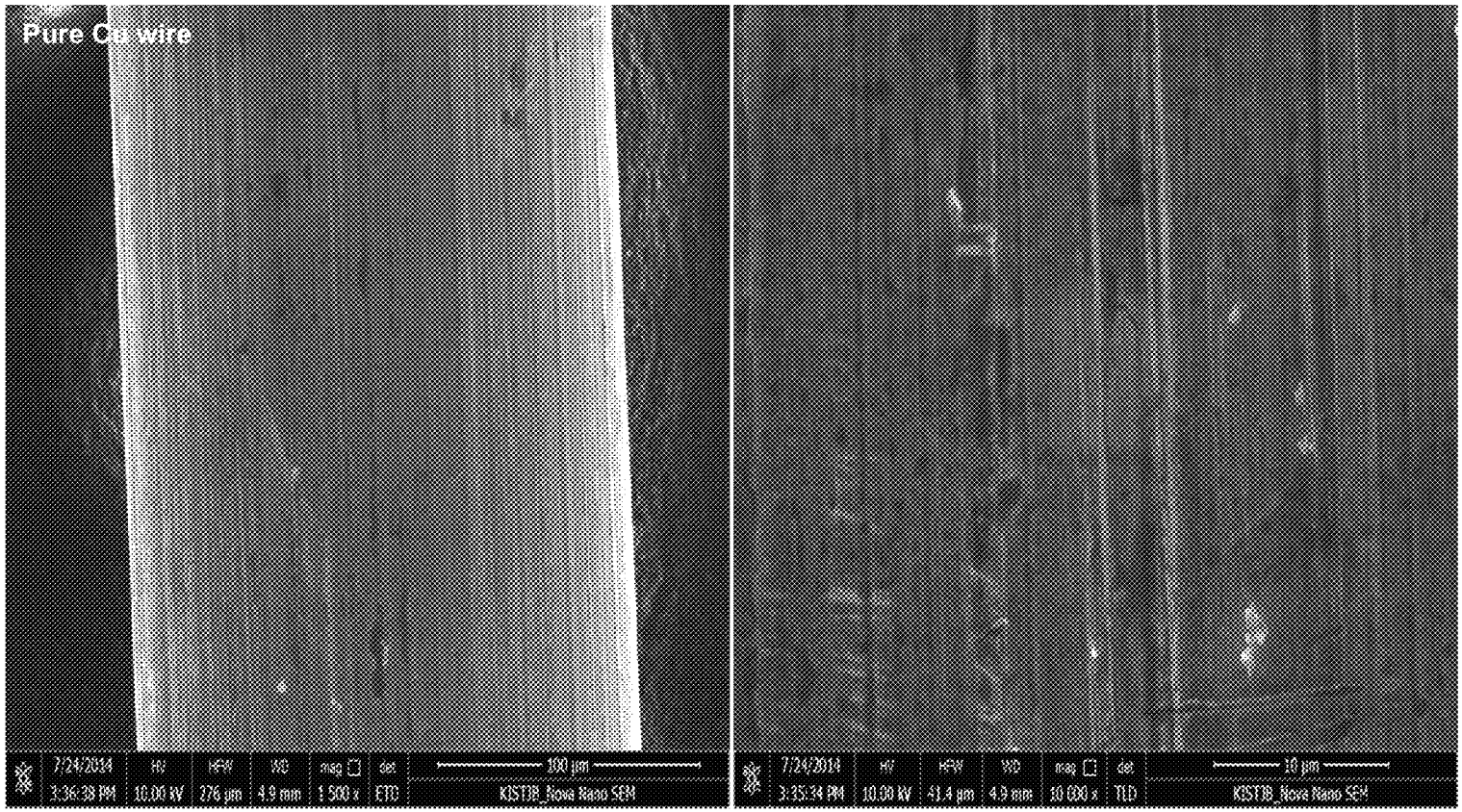

FIGS. 8A and 8B are SEM images showing the surface of the graphene/copper composite electric wire structure manufactured in Example 3 using a copper wire with a diameter of 0.192 mm (FIG. 8A) and the surface of a pristine copper wire (FIG. 8B).

It can be seen that, the graphene/copper composite electric wire structure has improved surface roughness as compared to the pristine copper wire due to the heat treatment (carbonization) and graphene flakes are formed thereon.

Figure 9A:
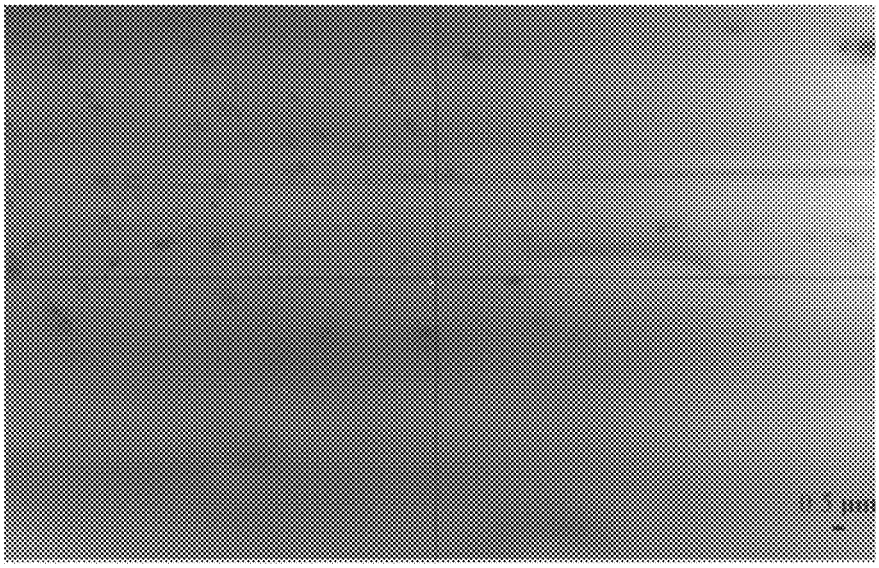
FIGS. 9A and 9B show the optical image (FIG. 9A) and Raman spectrum (FIG. 9B) of a graphene/copper composite electric wire structure manufactured in Example 3 using a copper wire with a diameter of 0.192 mm. The crystallinity of the graphene/copper composite electric wire can be confirmed from the graphene 2D peak observed at about 2700 $cm^{-1}$.
Figure 9B:
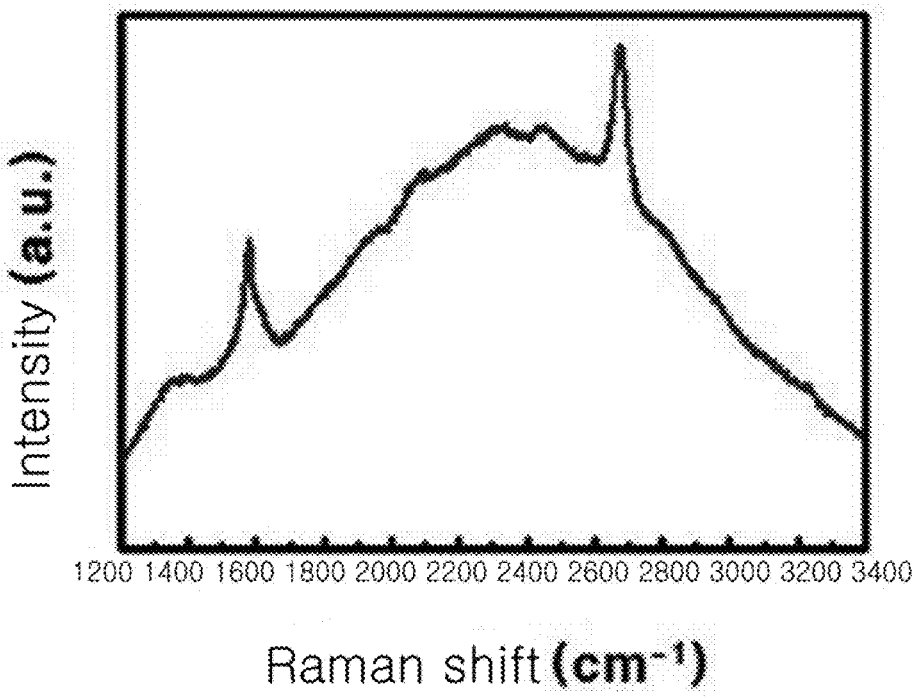

FIGS. 9A and 9B show the optical image (FIG. 9A) and Raman spectrum (FIG. 9B) of the graphene/copper composite electric wire structure manufactured in Example 3 using a copper wire with a diameter of 0.192 mm. The crystallinity of the graphene/copper composite electric wire could be confirmed from the graphene 2D peak observed at about 2700 $cm^{-1}$.

Figure 10:
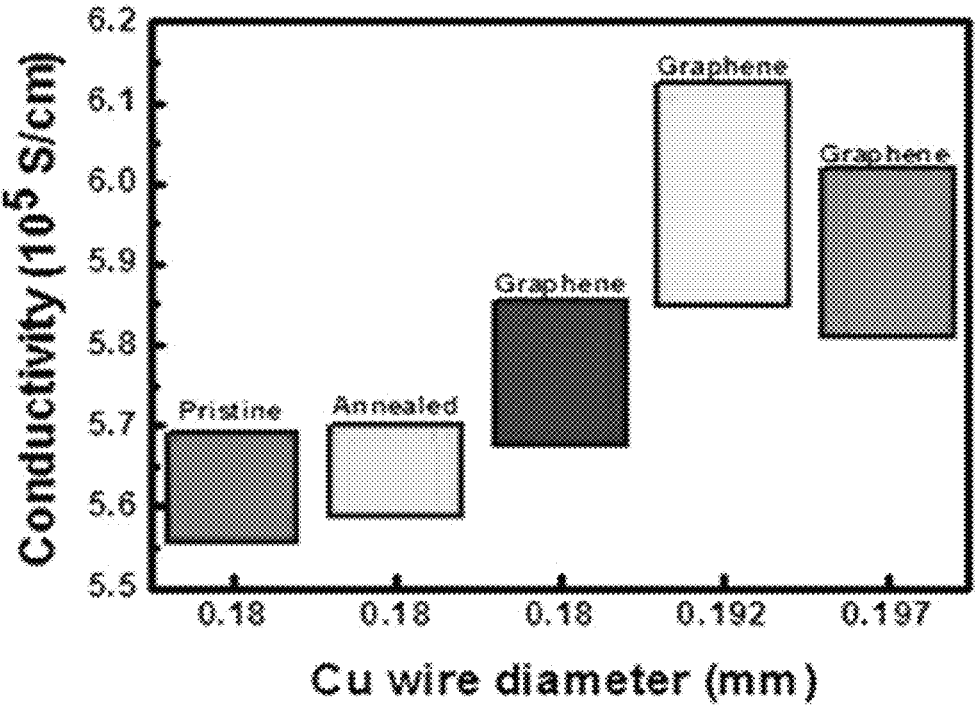
FIG. 10 shows a result of measuring electrical conductivity for Example 3 and Comparative Example 1 by the 4-point probe method.

FIG. 10 shows a result of measuring electrical conductivity for Example 3 and Comparative Example 1 by the 4-point probe method. In FIG. 10, the x-axis indicates the diameter of the copper wire used in Example 3 or Comparative Example 1, and the y-axis indicates electrical conductivity (unit: $10^5$ S/cm). In FIG. 10, the pristine copper wire is indicated by pristine and the heat-treated pristine copper wire is indicated by annealed. And, the graphene/copper composite electric wire structure on which the graphene island structure has been formed is indicated by graphene.

From FIG. 10, it can be seen that the graphene/copper composite electric wire structure has improved electrical conductivity than the pristine copper wire. The electrical conductivity of the copper wire which had been heat-treated only was similar to that of the pristine copper wire.

Figure 11:
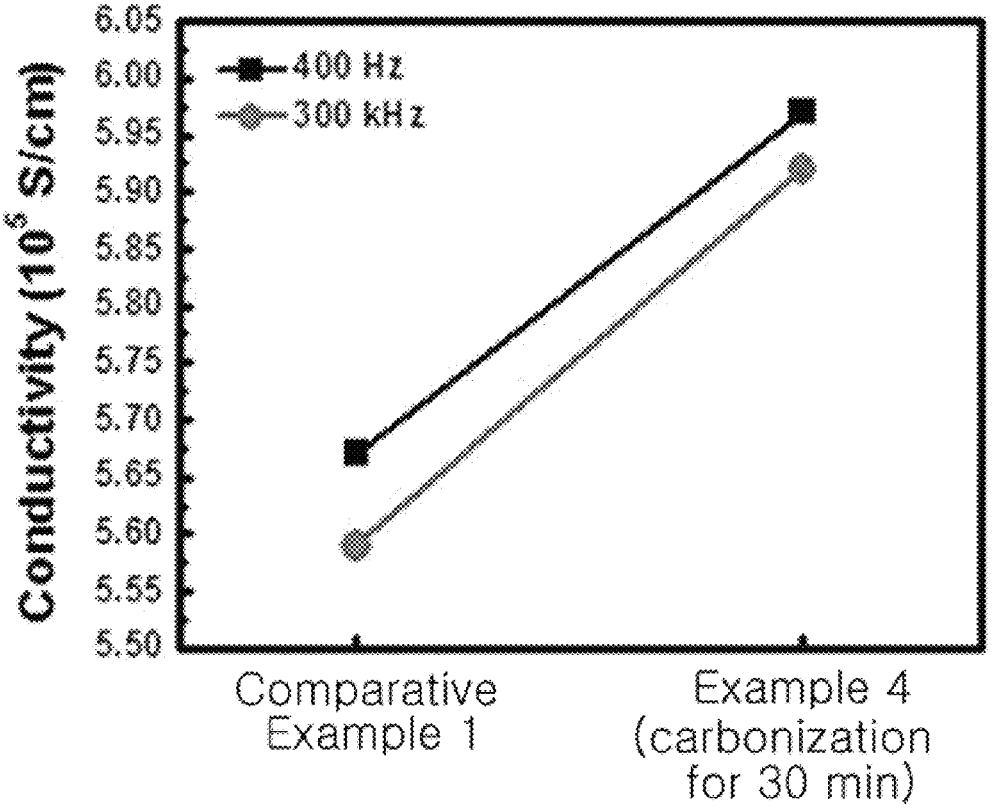
FIG. 11 shows the alternating current (AC) conductivity of a graphene/copper composite electric wire structure manufactured in Example 4 depending on carbonization time.

FIG. 11 shows the alternating current (AC) conductivity of the graphene/copper composite electric wire structure manufactured in Example 4 and the pristine copper wire of Comparative Example 1 (pristine) depending on carbonization time. In FIG. 11, the x-axis indicates the pristine copper wire of Comparative Example 1 and the graphene/copper composite electric wire structure of Example 4, and the y-axis indicates electrical conductivity (unit: $10^5$ S/cm).

From FIG. 11, it can be seen that the conductivity of the graphene/copper composite electric wire structure was improved by up to 5.78% as compared to the pristine copper wire depending on frequency.

Figure 12A:
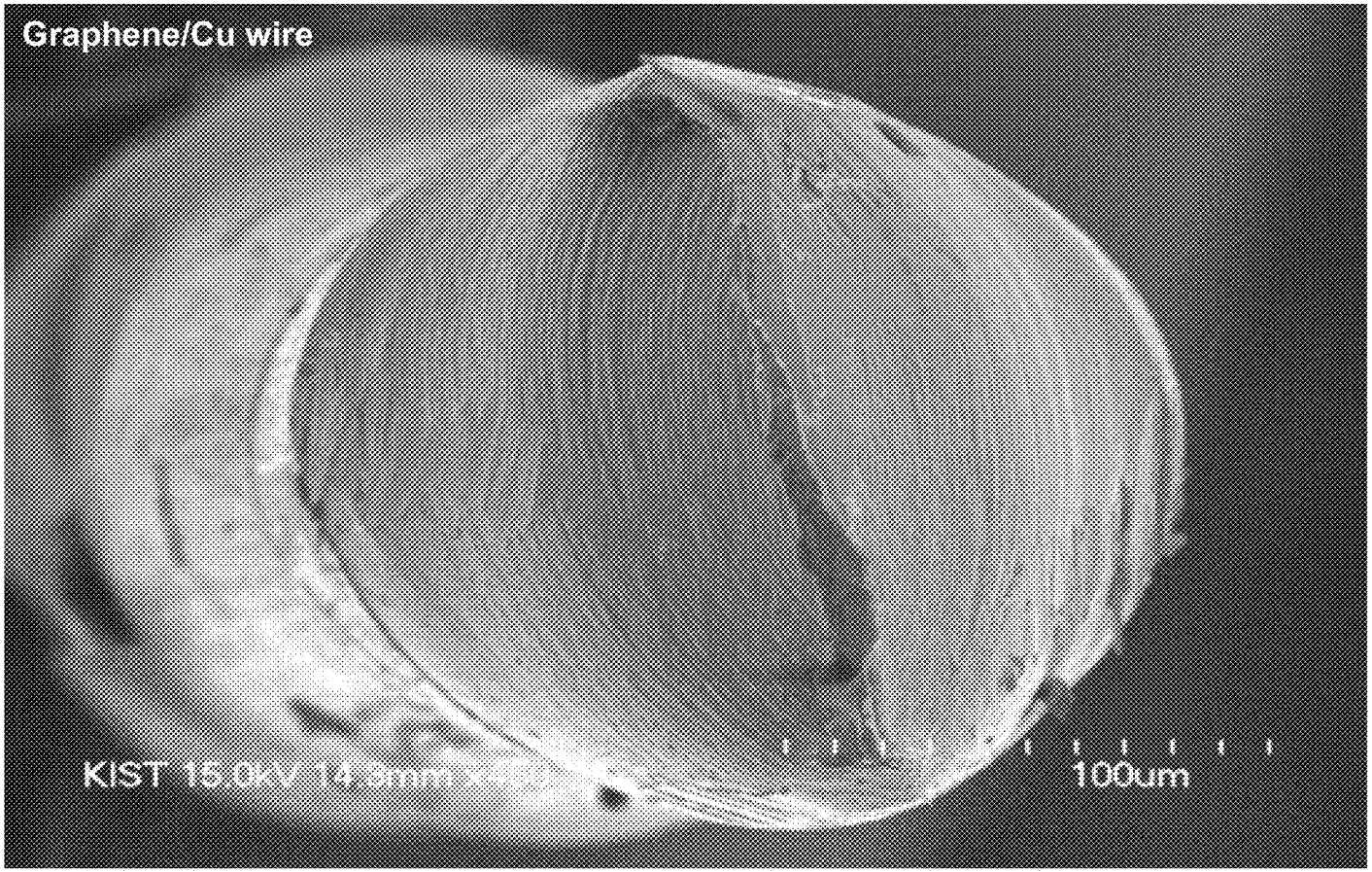
FIGS. 12A and 12B are SEM images of the fracture surface of a graphene/copper composite electric wire structure manufactured in Example 4 (FIG. 12A) and a pristine copper wire of Comparative Example 1 (FIG. 12B).
Figure 12B:
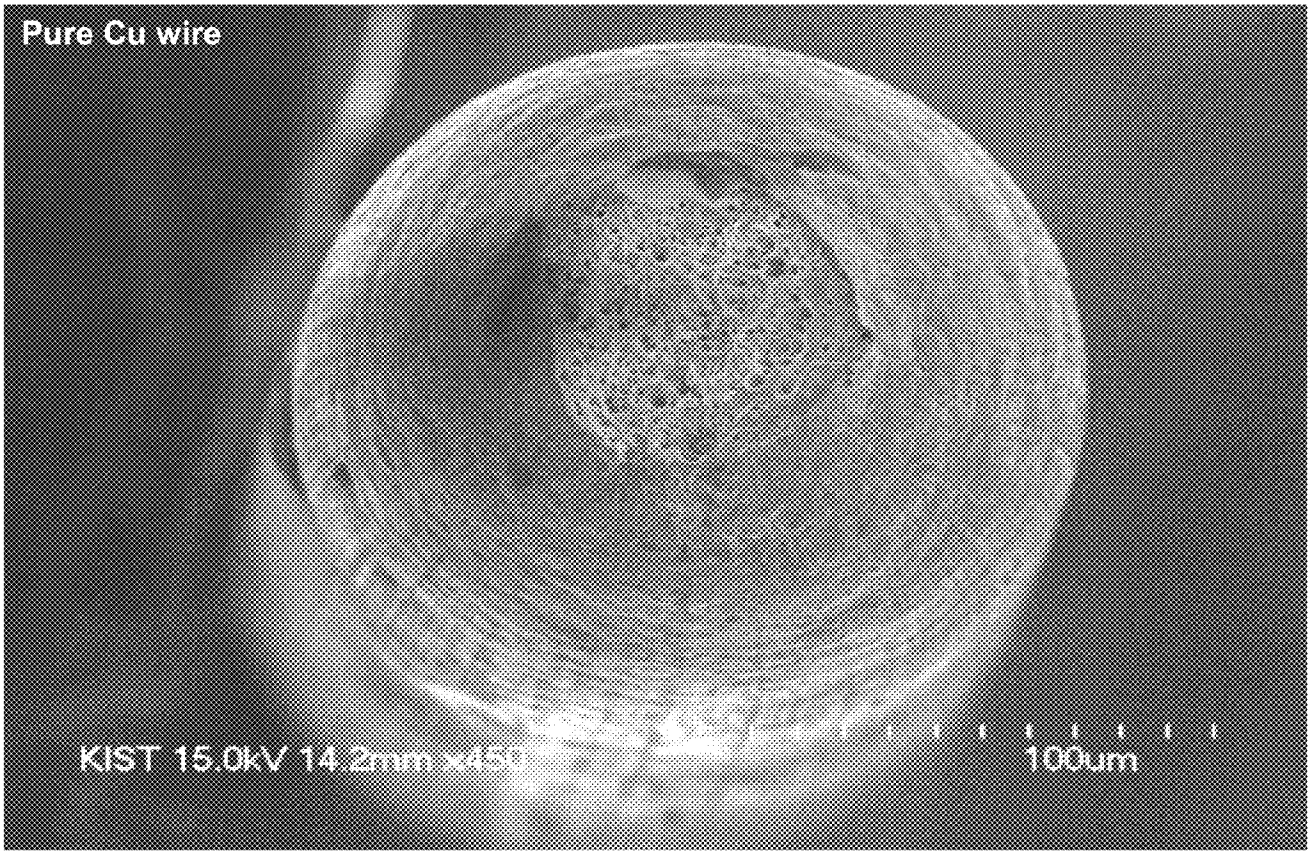

FIGS. 12A and 12B are SEM images of the fracture surface of the graphene/copper composite electric wire structure manufactured in Example 4 (FIG. 12A) and the pristine copper wire of Comparative Example 1 (FIG. 12B).

In order to evaluate the mechanical properties of the manufactured graphene/copper composite electric wire structure, modulus was measured using a universal testing machine (UTM).

Figure 13:
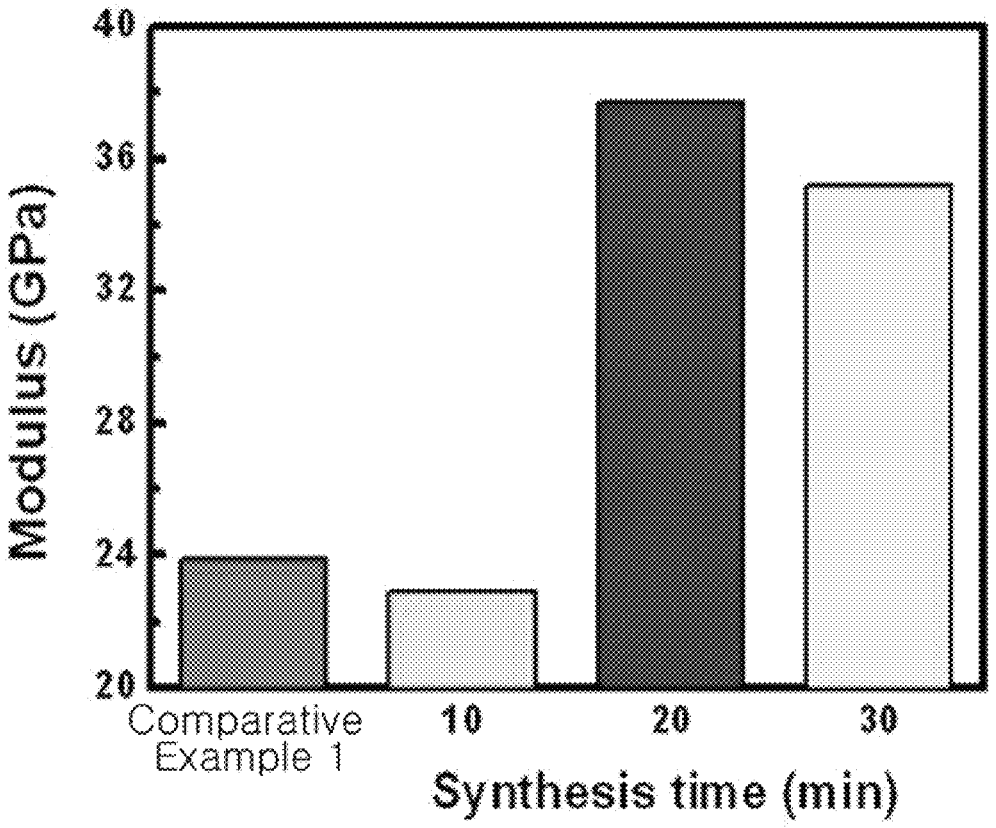
FIG. 13 shows the modulus of a graphene/copper composite electric wire structure manufactured in Example 4 and a pristine copper wire of Comparative Example 1 depending on carbonization time.

FIG. 13 shows the modulus of the graphene/copper composite electric wire structure manufactured in Example 4 and the pristine copper wire of Comparative Example 1 depending on carbonization time. In FIG. 13, the x-axis indicates the carbonization time of the pristine copper wire of Comparative Example 1 and the graphene/copper composite electric wire structure of Example 4, and the y-axis indicates modulus (unit: GPa).

From FIG. 13, it can be seen that the graphene/copper composite electric wire structure exhibits up to 2 times higher modulus than the pristine copper wire.

Figure 14:
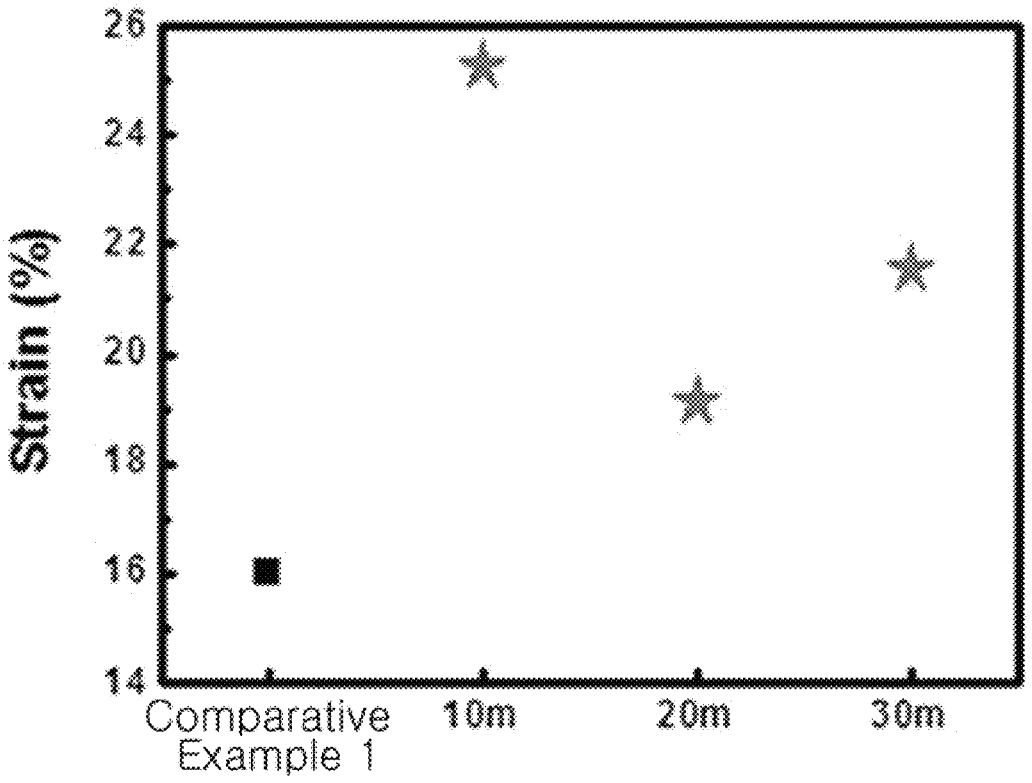
FIG. 14 shows improvement in the elongation of a graphene/copper composite electric wire structure manufactured in Example 4.

FIG. 14 shows improvement in the elongation of the graphene/copper composite electric wire structure manufactured in Example 4. In FIG. 14, the x-axis indicates the carbonization time of a pristine copper wire of Comparative Example 1 and the graphene/copper composite electric wire structure of Example 4, and the y-axis indicates elongation (unit: %). And, the fracture surface images of FIGS. 12A and 12B show the state where the copper wire was cut after being fully stretched. It can be seen that the graphene/copper composite electric wire was stretched more than the pristine copper wire and thus has superior flexibility.

Figure 15:
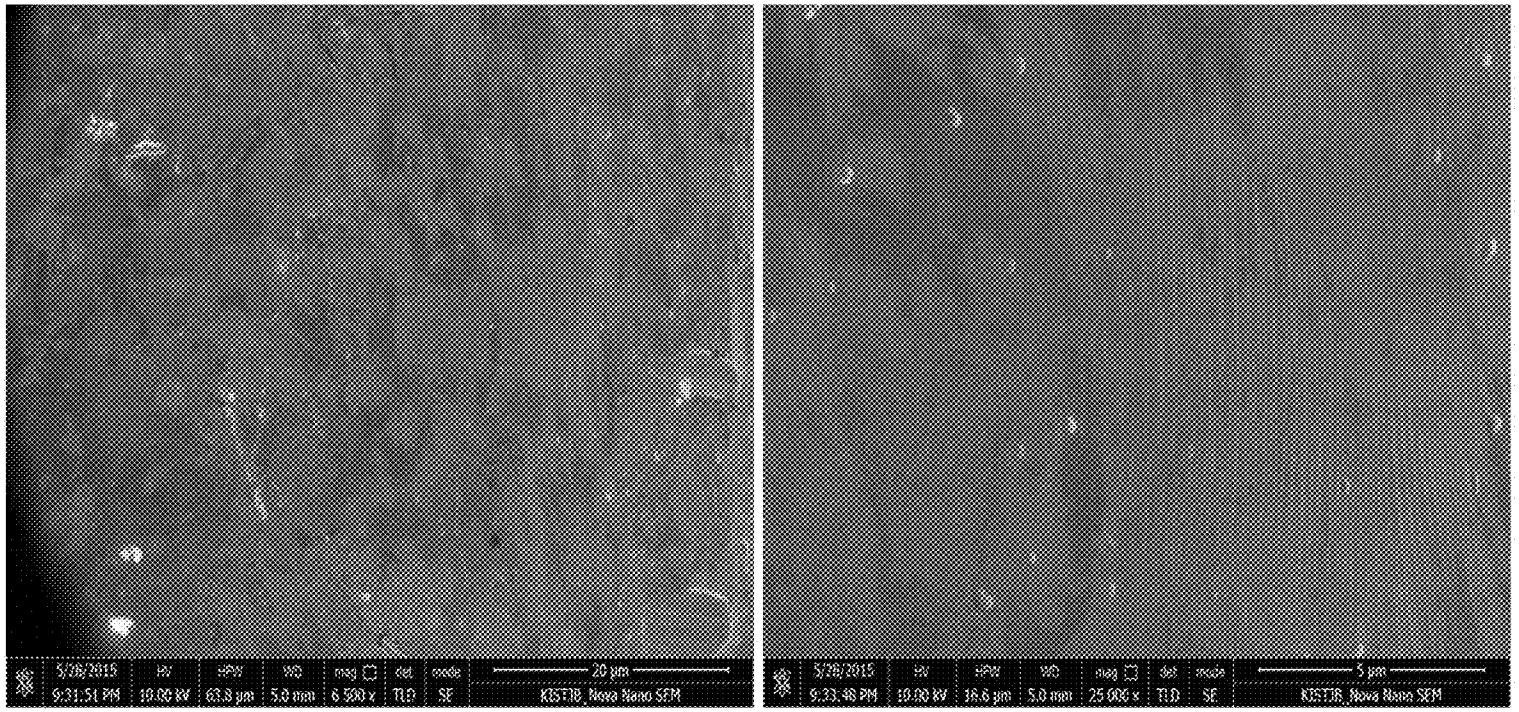
FIG. 15 is an SEM image for Comparative Example 2.
Figure 16:
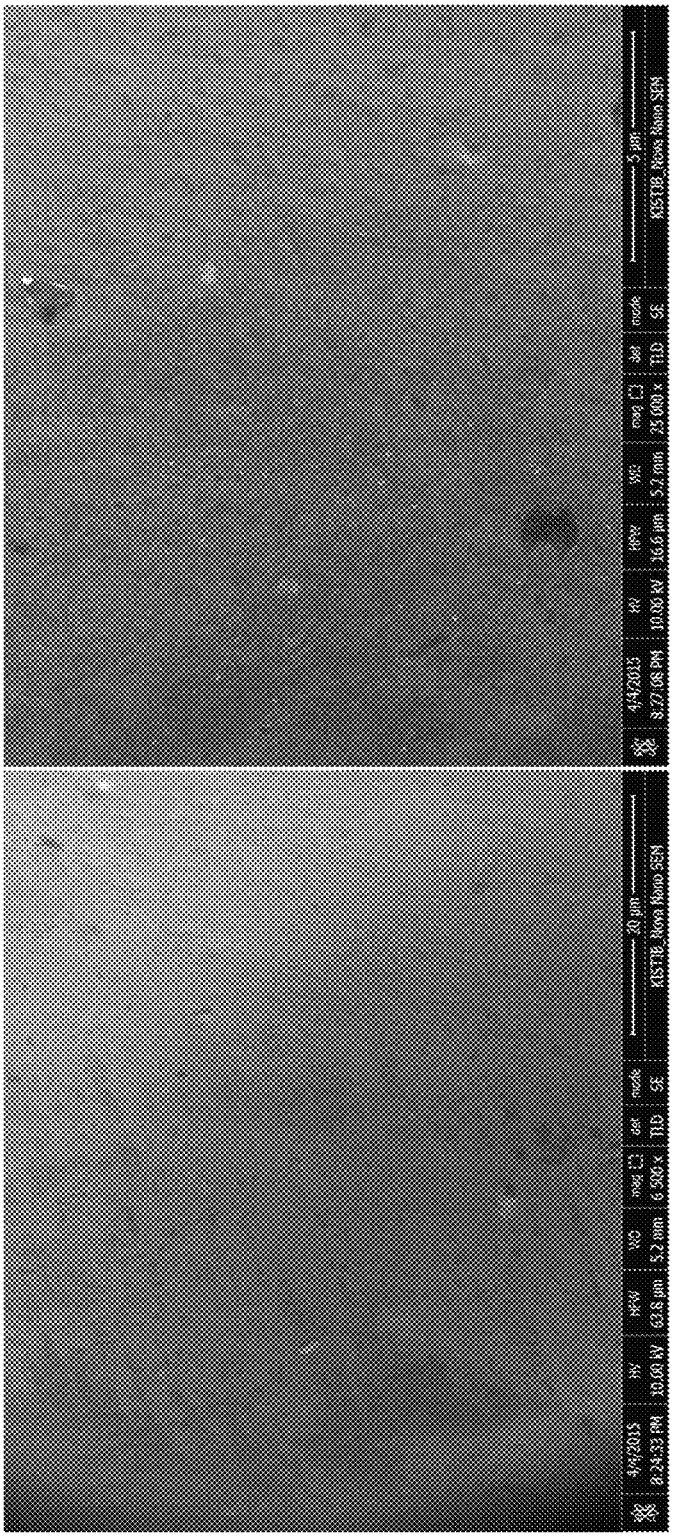
FIG. 16 is an SEM image for Comparative Example 3.

FIG. 15 is an SEM image for Comparative Example 2 and FIG. 16 is an SEM image for Comparative Example 3.

From FIGS. 15 and 16, it can be seen that graphene was coated wholly on the wire both for Comparative Example 2 wherein CVD was employed and Comparative Example 3 wherein the high-concentration polymer solution was used.

What is claimed is:

1. A composite electric wire structure comprising:

a metal wire; and a carbon material island structure present on a surface of the metal wire, wherein the carbon material island structure comprises carbon material flakes, wherein the carbon material flakes are positioned to be dispersed and isolated such that no continuous physical connection between the carbon material flakes is present from one end of the metal wire to an opposite end of the metal wire, wherein the carbon material flakes have grown on the surface of the metal wire, wherein the carbon material flakes comprise carbon material flakes that have grown from a metal grain boundary of the metal wire, and wherein the carbon material primarily comprises graphene.

2. The composite electric wire structure according to claim 1, wherein the composite electric wire structure further comprises a sheath covering the metal wire and the carbon material island structure, and the sheath contacts with the metal wire at a portion where the carbon material island structure is not present and contacts with a carbon material at a portion where the carbon material island structure is present.

3. The composite electric wire structure according to claim 2, wherein the sheath comprises an insulating sheath.

4. The composite electric wire structure according to claim 1, wherein the carbon material flakes are present on 5-90% of the total area of the metal wire.

5. The composite electric wire structure according to claim 1, wherein the carbon material flakes further comprise carbon material flakes that have grown from grains of the metal wire.

6. The composite electric wire structure according to claim 1, wherein the carbon material flakes comprise carbon material flakes doped with heterogeneous elements.

7. The composite electric wire structure according to claim 1, wherein the carbon material flakes further comprise an externally derived carbon in addition to polymer-derived carbon.

8. The composite electric wire structure according to claim 1, wherein the carbon material flakes have a thickness of 0.3-30 nm.

9. The composite electric wire structure according to claim 1, wherein the composite electric wire structure is a single strand or an aggregate of a plurality of single strands.

10. The composite electric wire structure according to claim 9, wherein the single-strand composite electric wire structure has a diameter of 10 nm to 100 cm.

11. The composite electric wire structure according to claim 1, wherein the composite electric wire structure exhibits 1% or more increase in electrical conductivity as compared to that of a metal wire wherein the carbon material island structure is not formed.

12. The composite electric wire structure according to claim 1, wherein the composite electric wire structure has an elasticity of 0.1-1000 GPa.

13. The composite electric wire structure according to claim 1, wherein the composite electric wire structure exhibits 1% or less decrease in at least one of electrical conductivity and elasticity when it is deformed from a linear state.

14. The composite electric wire structure according to claim 1, wherein the metal is a single crystalline metal or a polycrystalline metal.

15. The composite electric wire structure according to claim 1, wherein the metal is one or more selected from a group consisting of a transition metal, a non-transition metal, a post-transition metal or an alloy thereof, wherein the transition metal is one or more selected from a group consisting of Pt, Ru, Cu, Fe, Ni, Co, Pd, W, Ir, Rh, Sr, Ce, Pr, Nd, Sm and Re, the non-transition metal is one or more selected from a group consisting of Mg, B, Sn and Al, and the post-transition metal is one or more selected from a group consisting of Sn, Al and Pb.

16. The composite electric wire structure according to claim 1, wherein the metal wire is a multi-layered metal wire having a multi-layered structure.

17. The composite electric wire structure according to claim 1, wherein the metal wire is surface-treated.

* * * * *